US007729499B2

(12) United States Patent
Kokubo et al.

(10) Patent No.: US 7,729,499 B2
(45) Date of Patent: Jun. 1, 2010

(54) SPEAKER APPARATUS AND REPRODUCING APPARATUS

(75) Inventors: Wataru Kokubo, Tokyo (JP); Tomohiro Yamada, Kenagawa (JP)

(73) Assignee: Sony Corporation, Tokyo (JP)

( * ) Notice: Subject to any disclaimer, the term of this patent is extended or adjusted under 35 U.S.C. 154(b) by 1062 days.

(21) Appl. No.: 11/418,069

(22) Filed: May 5, 2006

(65) Prior Publication Data

US 2006/0269092 A1 Nov. 30, 2006

(30) Foreign Application Priority Data

May 9, 2005 (JP) ..... 2005-136741
Jul. 1, 2005 (JP) ..... 2005-194043

(51) Int. Cl.
*H04R 25/00* (2006.01)

(52) U.S. Cl. ..... 381/182; 381/335; 381/336; 381/186

(58) Field of Classification Search ..... 381/87, 381/89, 335, 336, 182, 186, 386, 387, 160; 181/144, 145, 147, 153, 155, 199
See application file for complete search history.

(56) References Cited

U.S. PATENT DOCUMENTS 3,500,953 A * 3/1970 Lahti ..... 181/151
4,219,099 A * 8/1980 Sacks ..... 181/153
4,357,490 A * 11/1982 Dickey ..... 381/336

FOREIGN PATENT DOCUMENTS

| | | |
|---|---|---|
| JP | 58-169787 | 11/1983 |
| JP | 7-212892 | 8/1995 |
| JP | 9-98495 | 4/1997 |

* cited by examiner

*Primary Examiner*—Huyen D Le
(74) *Attorney, Agent, or Firm*—Finnegan, Henderson, Farabow, Garrett & Dunner, L.L.P.

(57) ABSTRACT

The present invention provides a speaker apparatus and reproducing apparatus with no limitation on their listening areas. The apparatus includes; the housing 2 substantially in the shape of a spheroid; the left speaker 5A, which is attached to the left end of the long side of the housing 2 such that the left speaker 5A faces outwardly of the housing 2; and the right speaker 5B, which is attached to the right end of the long side of the housing 2 such that the right speaker 5B faces outwardly of the housing 2. Therefore, the left speaker 5A and the right speaker 5B are approximately equivalent to a point sound source, and the sound from the left speaker 5A and the right speaker 5B smoothly radiates from the housing 2 in every direction. Thus, a listener can have good quality of sound from anywhere around the housing.

7 Claims, 24 Drawing Sheets

SPEAKER APPARATUS AND REPRODUCING APPARATUS

CROSS REFERENCES TO RELATED APPLICATIONS

The present invention contains subject matter related to Japanese Patent Applications JP2005-136741 filed in the Japanese Patent Office on May 9, 2005 and JP2005-194043 filed in the Japanese Patent Office on Jul. 1, 2005, the entire contents of which being incorporated herein by reference.

BACKGROUND OF THE INVENTION

1. Field of the Invention

The preset invention relates to a speaker apparatus and reproducing apparatus, and is preferably applied to a stereophonic speaker apparatus, for example.

2. Description of the Related Art

A stereophonic speaker apparatus includes a pair of separated speaker devices; it has a left channel speaker device and a right channel speaker device. The left channel speaker device outputs left channel audio, while the right channel speaker device outputs right channel audio.

The left channel speaker device is usually placed on the left hand of a listener, and then the right channel speaker device is placed on the right hand of him/her. Since he/she is between the right channel speaker device and the left channel speaker device and is facing both the right channel speaker device and the left channel speaker device, he/she can listen to stereophonic sound.

However, to get good quality of stereophonic sound, a listener should be at a position where he/she faces both the right channel speaker device and the left channel speaker device and is the same distance away from each speaker device. In this way, an area where a listener can have good stereophonic sound is limited to a certain range (The area where a listener can have good stereophonic sound is also referred to as a "listening area").

Accordingly, in late years, a stereophonic speaker apparatus, which is for example disclosed in Jpn. Pat. Laid-open Publication No. H09-98495 (FIG. 1), includes a pair of separated speaker boxes for left and right channels with diaphragms which are fixed in clockwise and counterclockwise directions and are inclined at a prescribed angle with respect to the front faces of speaker boxes. Using these diaphragms expands its listening area.

SUMMARY OF THE INVENTION

However, though the above-noted stereophonic speaker apparatus expands its listening area to a certain degree, the listening area is substantially limited. In this manner, the listening area is limited with this kind of speaker apparatus.

The present invention has been made in view of the above points and is intended to provide a speaker apparatus and reproducing apparatus with no limitation on their listening areas.

In an embodiment of the present invention, a speaker apparatus and reproducing apparatus include: a housing substantially in the shape of a spheroid; a first speaker attached to one end of a long side of the housing, the first speaker having a diaphragm whose front face faces outwardly of the housing; a second speaker attached to another end of the long side of the housing, the second speaker having a diaphragm whose front face faces outwardly of the housing.

Therefore, the first speaker and the second speaker are approximately equivalent to a point sound source, and the sound from the first speaker and the second speaker smoothly radiates from the housing in every direction.

In an embodiment of the present invention, the speaker apparatus and reproducing apparatus include: a housing substantially in the shape of a spheroid; a first speaker attached to one end of a long side of the housing, the first speaker having a diaphragm whose front face faces outwardly of the housing; a second speaker attached to another end of the long side of the housing, the second speaker having a diaphragm whose front face faces outwardly of the housing. Therefore, the first speaker and the second speaker are approximately equivalent to a point sound source, and the sound from the first speaker and the second speaker smoothly radiates from the housing in every direction. Since the speaker apparatus and reproducing apparatus have a smooth and wide directivity, a listener can have good quality of sound from anywhere around the housing. Thus, the speaker apparatus and reproducing apparatus have no limitation on the listening areas.

The nature, principle and utility of the present invention will become more apparent from the following detailed description when read in conjunction with the accompanying drawings in which like parts are designated by like reference numerals or characters.

DETAILED DESCRIPTION OF PREFERRED EMBODIMENTS

An embodiment of the present invention will be described in detail with reference to the accompanying drawings.

(1) External Structure of Stereophonic Speaker Device

Figure 1A:
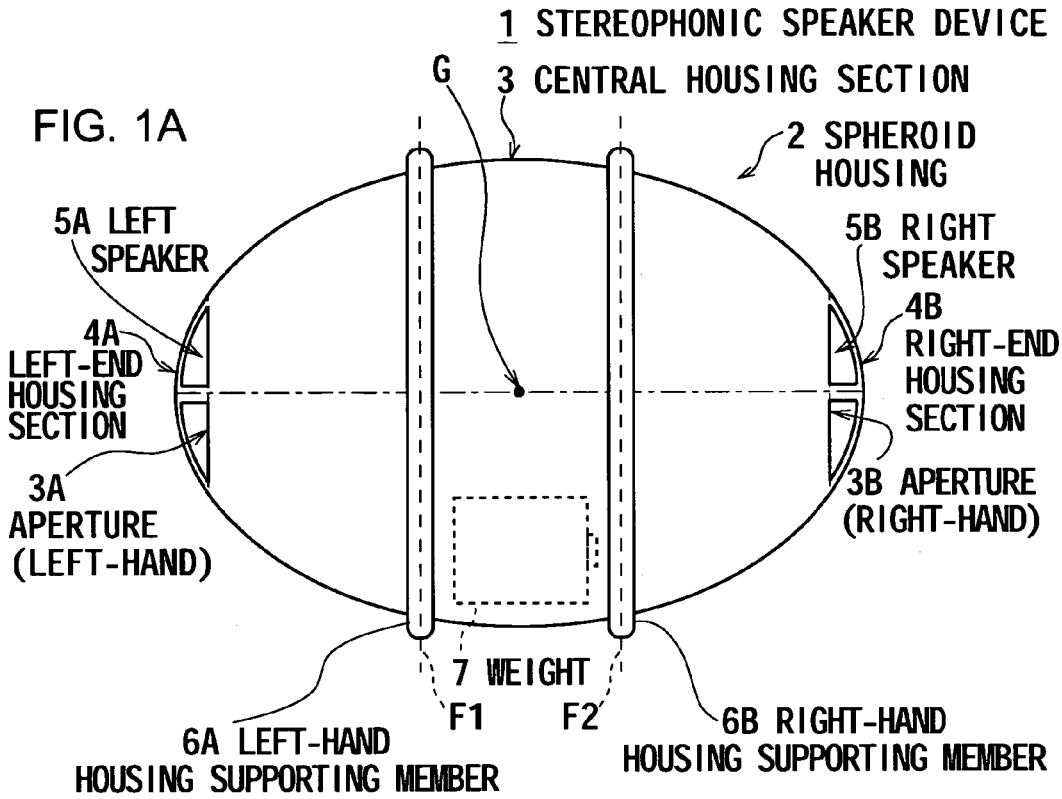
FIGS. 1A and 1B are schematic diagrams showing the external structure of a stereophonic speaker device.
Figure 1B:
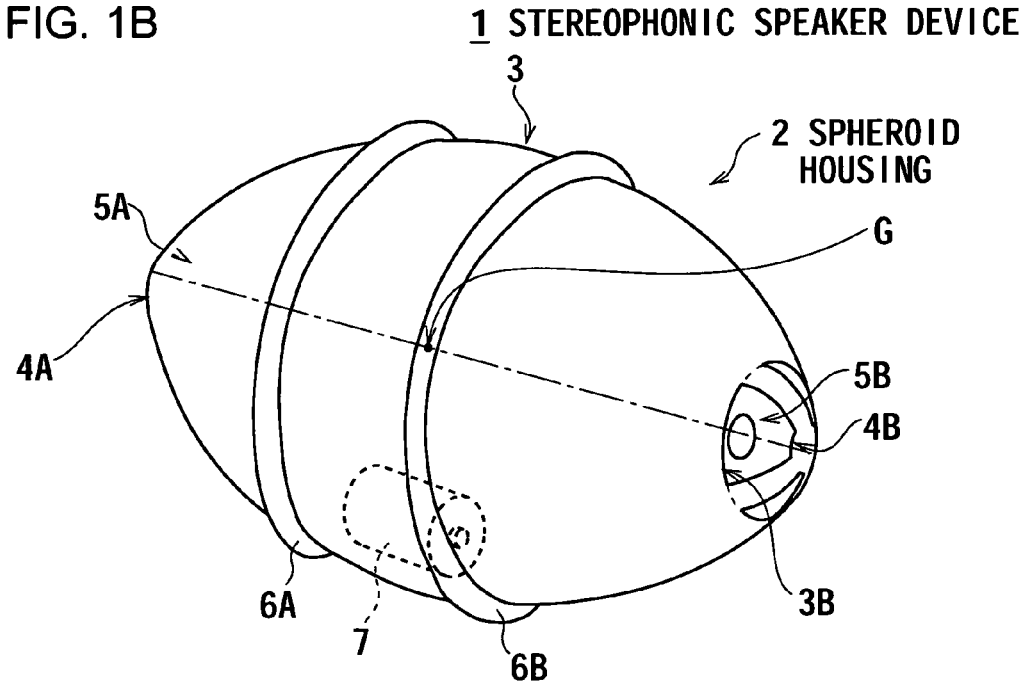

In FIGS. 1A and 1B, the reference numeral 1 represents a stereophonic speaker device with a built-in amplifier. The stereophonic speaker device 1 includes a hollow housing 2 which is substantially in the shape of a spheroid. The spheroid housing 2 includes a central housing section 3, a one-end housing section 4A, and an other-end housing section 4B. The central housing section 3, the one-end housing section 4A, and the other-end housing section 4B are formed in the following manner: two cutting planes (an one-end cutting plane and other-end cutting plane) are set at two locations, each of which is the same distance away from a central point G of the spheroid, in a vertical direction with respect to a long axis of the spheroid; and, the spheroid housing 2 is cut down along the one-end cutting plane and the other-end cutting plane. As a result, two circular apertures 3A and 3B are formed at the one-end cutting plane and other-end cutting plane of the central housing section 3. The one-end housing section 4A, which is substantially in the shape of a dome, is connected to the one-end cutting plane of the central housing section 3 such that the one-end housing section 4A covers the apertures 3A. The other-end housing section 4B, which is substantially in the shape of a dome, is connected to the other-end cutting plane of the central housing section 3 such that the other-end housing section 4B covers the apertures 3B. In this manner, the central housing section 3, the one-end housing section 4A, and the other-end housing section 4B make up the shape of the spheroid.

The long axis of the spheroid housing 2 will be also referred to as a horizontal central axis (This horizontal central axis will be also referred to as a housing-central axis). The one-end housing section 4A and the other-end housing section 4B will be also referred to as a left-end housing section 4A and a right-end housing section 4B, respectively. When a listener is in a position where he/she can see the left-end housing section 4A on his/her left hand and the right-end housing section 4B on his/her right hand, the face of stereophonic speaker device 1 which he/she is facing is a front face of stereophonic speaker device 1. The apertures 3A and 3B will be also referred to as a left-hand aperture 3A and a right-hand aperture 3B.

A speaker 5A for left channel audio and a speaker 5B for right channel audio are placed inside the central housing section 3 such that the speakers 5A and 5B are in diametrically opposed positions and are the same distance away from the central point G on the housing-central axis (The speaker 5A for left channel audio and the speaker 5B for right channel audio will be also referred to as a left speaker and a right speaker, respectively). Specifically, the left speaker 5A is disposed inside the central housing section 3 such that the left speaker 5A blocks up the left-hand aperture 3A from inside and that a front face of its diaphragm, which is substantially in the shape of a disk, is exposed outside through the left-hand aperture 3A. In the same way, the right speaker 5B is disposed inside the central housing section 3 such that the right speaker 5B blocks up the right-hand aperture 3B from inside and that a front face of its diaphragm, which is substantially in the shape of a disk, is exposed outside through the right-hand aperture 3B. Inside the central housing section 3, a back face of the diaphragm of the left speaker 5A faces a back face of the diaphragm of the right speaker 5B. In this manner, the left speaker 5A is equipped with a baffle which is substantially in the shape of a hemispheroid. That is to say, the baffle of the left speaker 5A has a smoothly curved surface that extends from the edge of the diaphragm of the left speaker 5A to the rear of the diaphragm. In addition, the right speaker 5B is equipped with a baffle which is substantially in the shape of a hemispheroid. That is to say, the baffle of the right speaker 5B has a smoothly curved surface that extends from the edge of the diaphragm of the right speaker 5B to the rear of the diaphragm. The baffles of the left speaker 5A and right speaker 5B are connected to each other in a seamless manner such that the back face of the diaphragm of the left speaker 5A faces the back face of the diaphragm of the right speaker 5B.

In addition, the central housing section 3 has a left-hand housing supporting member 6A and a right-hand housing supporting member 6B. The left-hand housing supporting member 6A is in the shape of a ring. The right-hand housing supporting member 6B is in the same shape as the left-hand housing supporting member 6A. For ease of explanation, an imaginary left-hand plane F1 and an imaginary right-hand plane F2, which are the same distance away from the central point G and are perpendicular to the housing-central axis, are set to the central housing section 3. In this case, the left-hand housing supporting member 6A and the right-hand housing supporting member 6B are formed along the imaginary left-hand plane F1 and the imaginary right-hand plane F2, respectively. Specifically, the left-hand housing supporting member 6A is provided around the outer circumference of the central housing section 3 such that the left-hand housing supporting member 6A protrudes from the central housing section 3. In the same way, the right-hand housing supporting member 6B is provided around the outer circumference of the central housing section 3 such that the right-hand housing supporting member 6B protrudes from the central housing section 3.

The cross sections of the ring-shaped left-hand housing supporting member 6A and right-hand housing supporting member 6B are in the shape of a semicircle where its internal circumference is wider than its outer circumference. In addition, the outside diameters of the left-hand housing supporting member 6A and right-hand housing supporting member 6B are a little bit larger than the maximum outside diameter of central housing section 3 (This maximum outside diameter of central housing section 3 is perpendicular to the housing-central axis). For example, the outside diameters of the left-hand housing supporting member 6A and right-hand housing supporting member 6B are a few millimeter larger than the maximum outside diameter of central housing section 3. Therefore, when the stereophonic speaker device 1 is placed on a plane such as a surface of a table, one spot of the left-hand housing supporting member 6A on its outer circumference and one spot of the right-hand housing supporting member 6B on its outer circumference touch the plane. This prevents the central housing section 3 from being in contact with the plane. In this manner, the left-hand housing supporting member 6A and the right-hand housing supporting member 6B horizontally supports the central housing section 3 a little above the plane. Since only the two spots of the stereophonic speaker device 1 touch the plane, a large amount of vibration from the spheroid housing 2 does not get into the plane.

In addition, since the central housing section 3 of the stereophonic speaker device 1 is supported a little above the plane by the ring-shaped left-hand housing supporting member 6A and right-hand housing supporting member 6B, the left speaker 5A and the right speaker 5B do not touch the plane but are very close to the plane. Therefore, putting the stereophonic speaker device 1 on the plane made of rigid material with good reflectiveness enhances low-pitched sound from the left speaker 5A and the right speaker 5B due to the baffle effect. The baffle effect is due to the fact that the sound from the left speaker 5A and the right speaker 5B is also reflected from the adjacent plane as if a position on the opposite side of the plane from the left and right speakers 5A and 5B also emits sound. This enhances (doubles) the low-frequency range of the sound (This range is determined based on a ratio of a distance between the left speaker 5A and the right speaker 5B to a wavelength of the sound). That is to say, since the reflection is in phase with the direct sound at low frequencies, the reflections from the plane enhance the direct sound from the left speaker 5A and the right speaker 5B.

The central housing section 3 has a weight 7 inside it. Specifically, the weight 7 is placed at a central area of an inner bottom face of the central housing section 3. Therefore, the central housing section 3 has a low center of gravity. This weight 7 holds the central housing section 3 horizontally and prevents the central housing section 3 from rotating on the housing-central axis, when the stereophonic speaker device 1 is placed on the plane. In this manner, only two points of the stereophonic speaker device 1, which are the outer circumference sections of the left-hand housing supporting member 6A and the right-hand housing supporting member 6B, contact with the plane. Nonetheless the stereophonic speaker device 1 works like a tumble doll. By the way, when the stereophonic speaker device 1 emits sound, the diaphragms of the left speaker 5A and right speaker 5B vibrate along the housing-central axis, which vertically penetrates both the diaphragms. When the stereophonic speaker device 1 is placed on the plane, the two points of the stereophonic speaker device 1, which are the left-hand housing supporting member 6A and the right-hand housing supporting member 6B, contact with the plane. These two points are in a line parallel to the housing-central axis. Therefore, even if the diaphragms of the left speaker 5A and right speaker 5B vibrate along the housing-central axis, these two points prevent the central housing section 3 from vibrating. Thus, the stereophonic speaker device 1 reproduces audio data and then emits left-channel audio and right-channel audio through the left speaker 5A and the right speaker 5B without moving on the plane (such as a table). In the present embodiment, the left-hand housing supporting member 6A and the right-hand housing supporting member 6B are for example made from elastic material such as rubber and silicones. The left-hand housing supporting member 6A and the right-hand housing supporting member 6B may be also made from rigid material such as metal and plastic. It is desirable to make a contact area between the plane where the stereophonic speaker device 1 is placed and the supporting members as small as possible.

The left-end housing section 4A and the right-end housing section 4B, which are substantially in the shape of a dome, are formed by curving a latticed plate which is in the shape of a cruciform. These left-end housing section 4A and right-end housing section 4B are attached to the central housing section 3 such that the left-end housing section 4A and the right-end housing section 4B cover the left-hand aperture 3A and the right-hand aperture 3B. Therefore, the left-end housing section 4A and right-end housing section 4B can protect the left speaker 5A and the right speaker 5B, which are exposed outside through the left-hand aperture 3A and the right-hand aperture 3B, without blocking off sound from the left speaker 5A and the right speaker 5B. In addition, since the left-end housing section 4A and the right-end housing section 4B are in the shape of a lattice, the left-end housing section 4A and the right-end housing section 4B can correct the quality of the sound. That is to say, the left-end housing section 4A and the right-end housing section 4B work like a speaker grille for protection, and also work like an equalizer for correcting frequency characteristics of the sound.

(2) Internal Structure of Stereophonic Speaker Device

Figure 2:
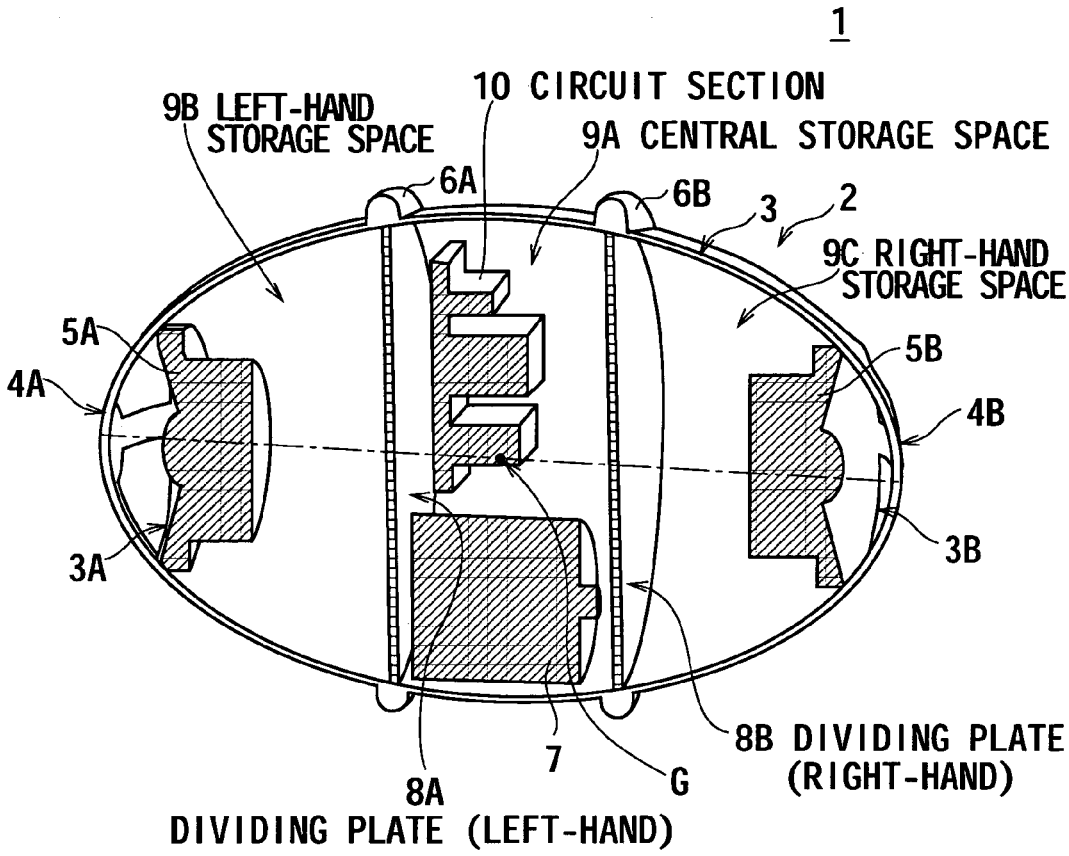
FIG. 2 is a schematic diagram showing the internal structure of the stereophonic speaker device.

Referring to FIG. 2, the internal structure of the stereophonic speaker device 1 will be described. FIG. 2 is a cross-section view of the spheroid housing 2 taken along an imaginary plane that splits the spheroid housing 2 from the top to the bottom. As shown in FIG. 2, the central housing section 3 has a pair of dividing plates 8A and 8B inside it. The dividing plate 8A is disposed in the inner left side of the central housing section 3. The dividing plate 8B is disposed in the inner right side of the central housing section 3. The dividing plates 8A and 8B are the same distance away from the central point G and are perpendicular to the housing-central axis. The dividing plate 8A on the left side will be referred to as a left-hand dividing plate 8A, and the dividing plate 8B on the right side will be referred to as a right-hand dividing plate 8B.

The left-hand dividing plate 8A and the right-hand dividing plate 8B create three storage spaces 9A, 9B and 9C inside the central housing section 3. The central storage space 9A is between the left-hand dividing plate 8A and the right-hand dividing plate 8B. The left-hand storage space 9B is on the left side of the left-hand dividing plate 8A. The right-hand storage space 9C is on the right side of the right-hand dividing plate 8B, and is the same size as the left-hand storage space 9B.

The central storage space 9A stores the weight 7 and a circuit section 10 including an amplifier. The weight 7 may be a battery that activates the circuit section 10. The left-hand storage space 9B stores the left speaker 5A such that only the front face of its diaphragm is exposed outside through the left-hand aperture 3A. The right-hand storage space 9C stores the right speaker 5B such that only the front face of its diaphragm is exposed outside through the right-hand aperture 3B. Therefore, the left-hand storage space 9B and the right-hand storage space 9C work as speaker boxes for the left speaker 5A and the right speaker 5B. Since the left-hand storage space 9B and the right-hand storage space 9C are the same shape and size, sound from the right speaker 5B has the same frequency characteristic as sound from the left speaker 5A.

(3) Operation and Effect

The stereophonic speaker device 1 with the above configuration receives stereophonic audio signals from an external device via an external input terminal (not shown). In the stereophonic speaker device 1, the circuit section 10 amplifies the stereophonic audio signals. The circuit section 10 subsequently extracts left-channel audio signals from the stereophonic audio signals, and then supplies the left-channel audio signals to the left speaker 5A. At the same time, the circuit section 10 extracts right-channel audio signals from the stereophonic audio signals, and then supplies the right-channel audio signals to the right speaker 5B.

Based on the left-channel audio signals and the right-channel audio signals, the left speaker 5A and right speaker 5B in the stereophonic speaker device 1 emit left-channel audio and right-channel audio, respectively.

The sound level distribution on the surface of the spheroid housing 2 and around the spheroid housing 2 will be described below. In this case, for example, measurements have been conducted for the stereophonic speaker device 1 on a plate (such as a table) emitting stereophonic sound from the left speaker 5A and the right speaker 5B.

Figure 3B:
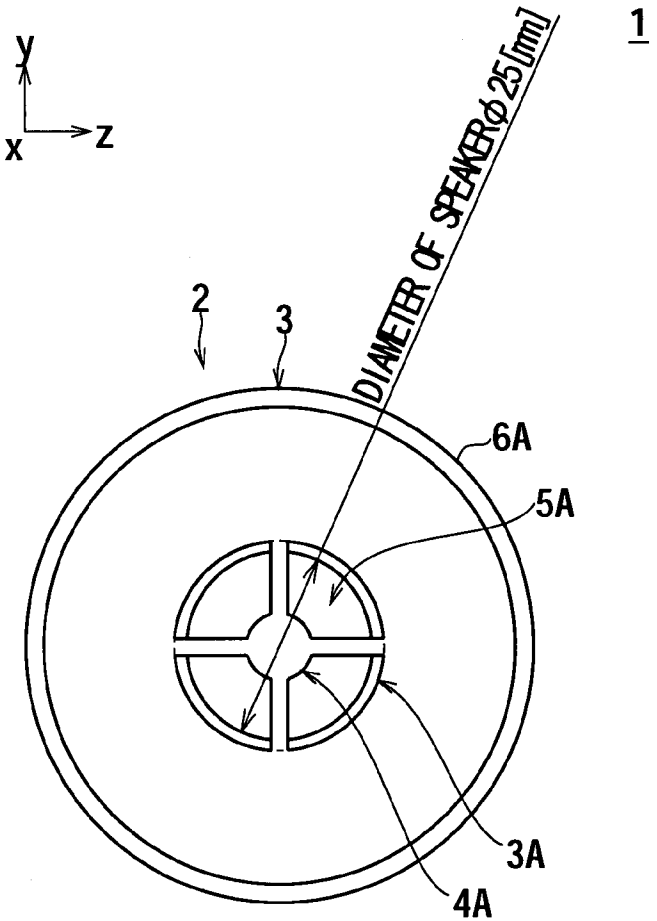
FIGS. 3A and 3B are schematic diagrams showing the dimensions of the stereophonic speaker device.
Figure 3A:
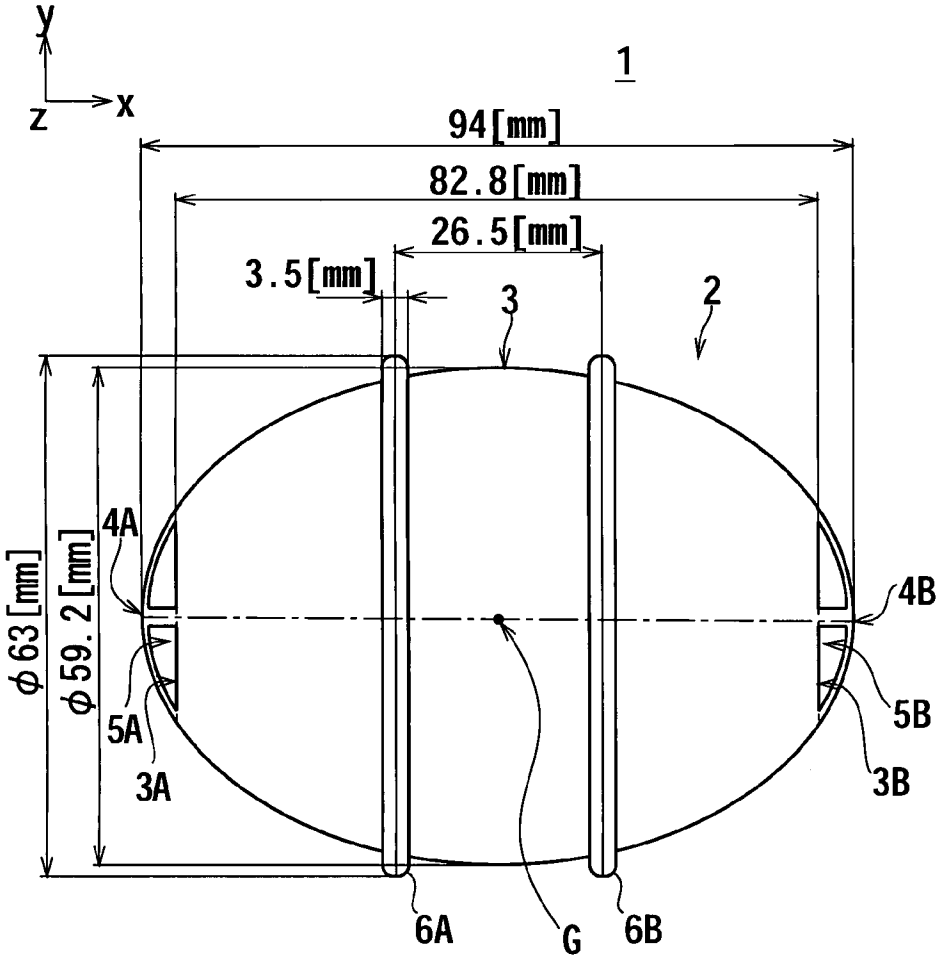
Figure 4:
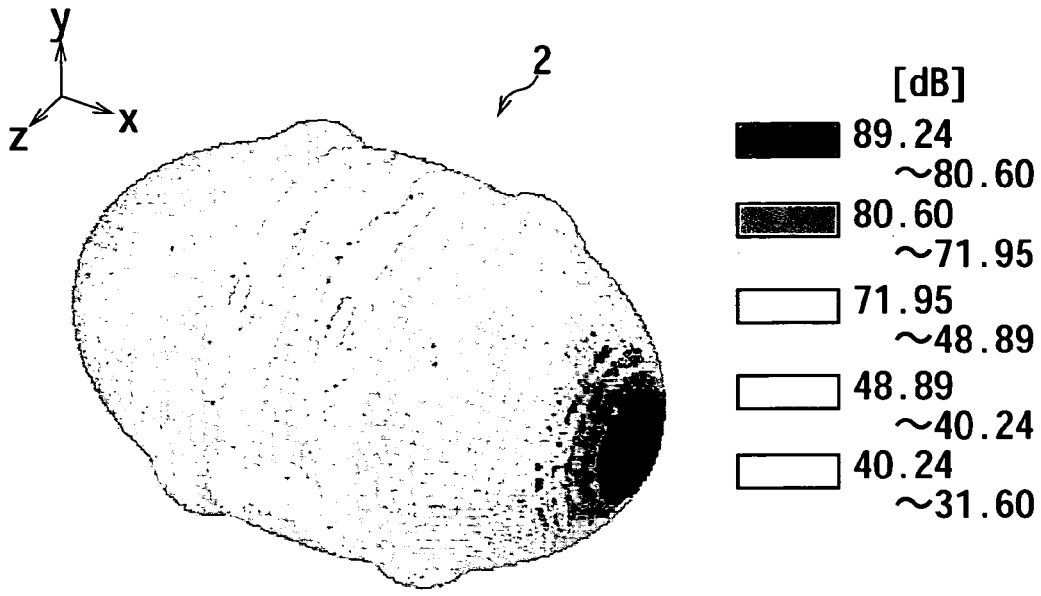
FIG. 4 is a schematic diagram showing the sound level distribution on a surface of spheroid housing (Frequency: 10 kHz)
Figure 5:
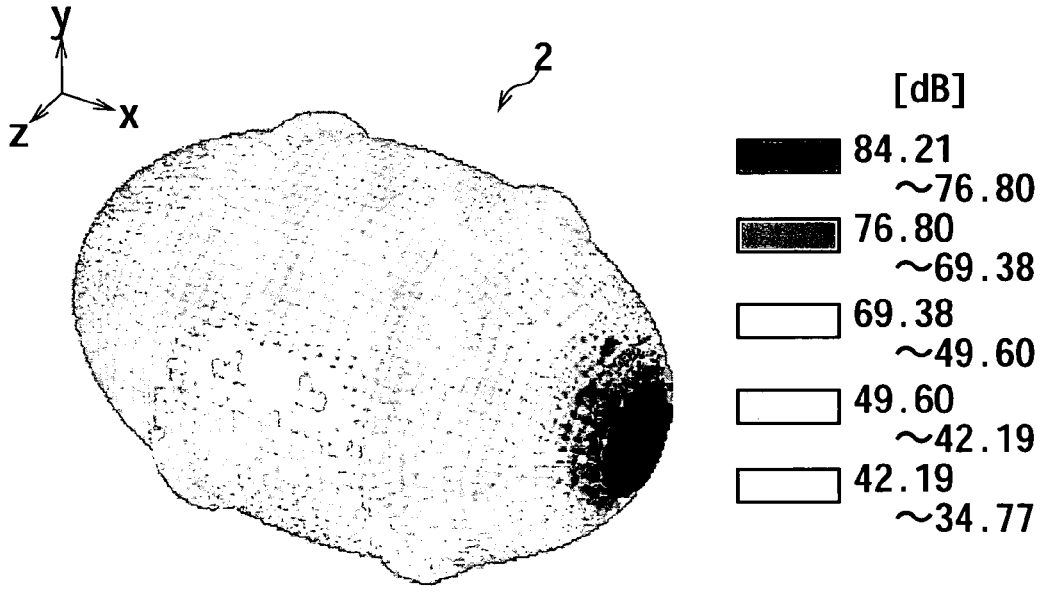
FIG. 5 is a schematic diagram showing the sound level distribution on the surface of spheroid housing (Frequency: 5 kHz)
Figure 6:
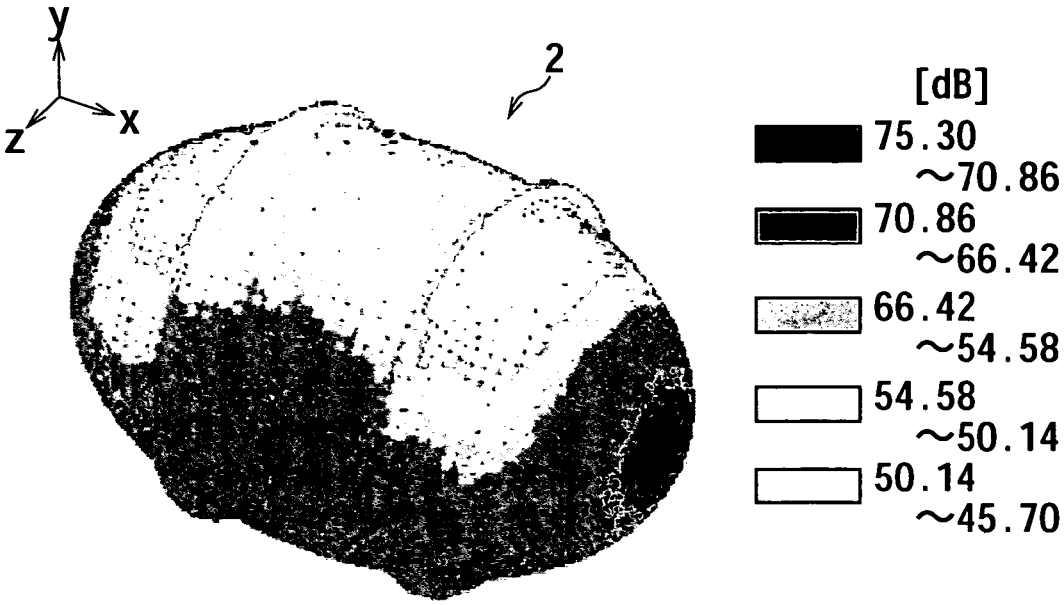
FIG. 6 is a schematic diagram showing the sound level distribution on the surface of spheroid housing (Frequency: 2 kHz)
Figure 7:
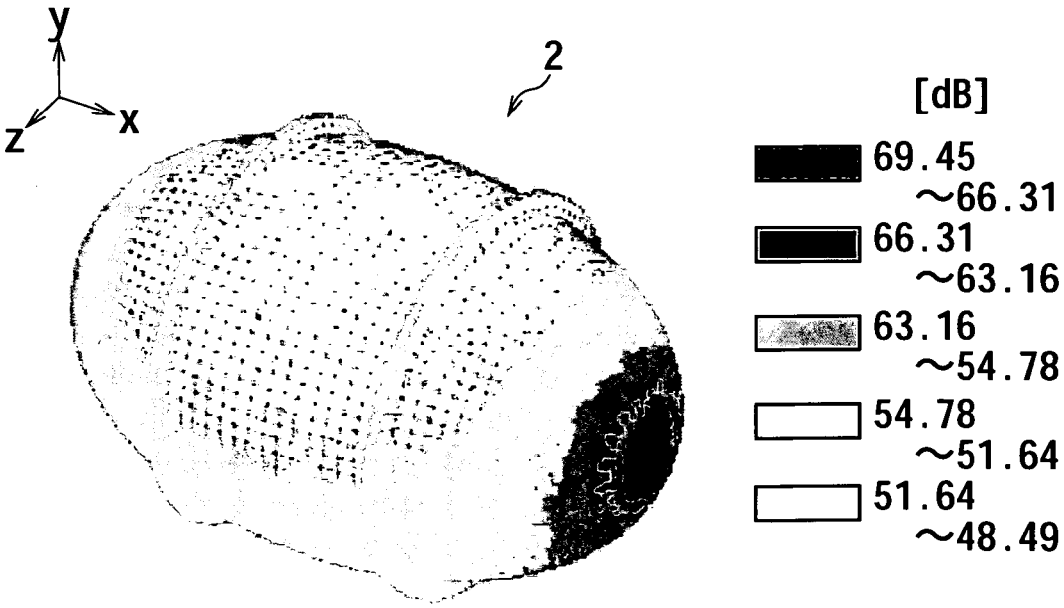
FIG. 7 is a schematic diagram showing the sound level distribution on the surface of spheroid housing (Frequency: 1 kHz)
Figure 8:
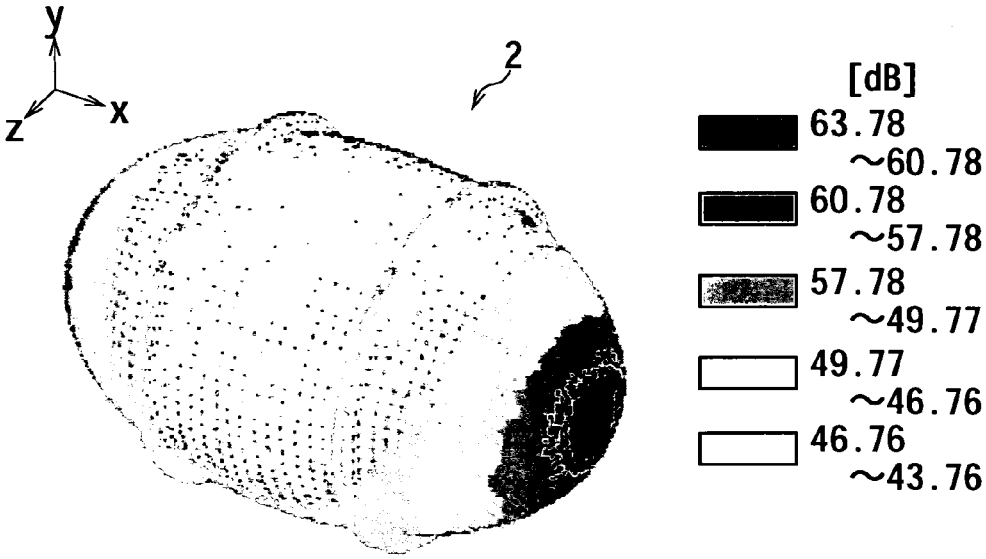
FIG. 8 is a schematic diagram showing the sound level distribution on the surface of spheroid housing (Frequency: 500 Hz)
Figure 9:
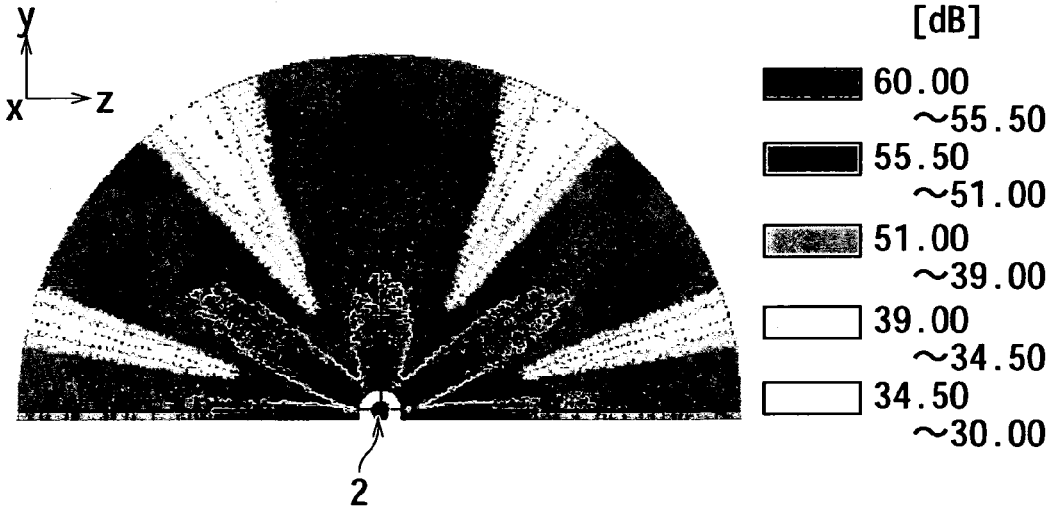
FIG. 9 is a schematic diagram showing the sound level distribution around the spheroid housing on an yz-plane (Frequency: 10 kHz)
Figure 10:
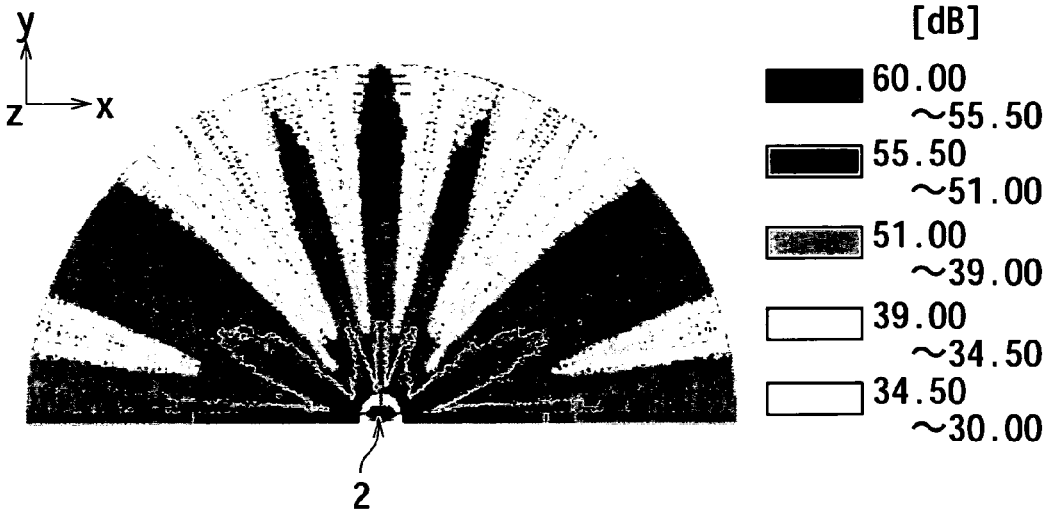
FIG. 10 is a schematic diagram showing the sound level distribution around the spheroid housing on a xy-plane (Frequency: 10 kHz)
Figure 11:
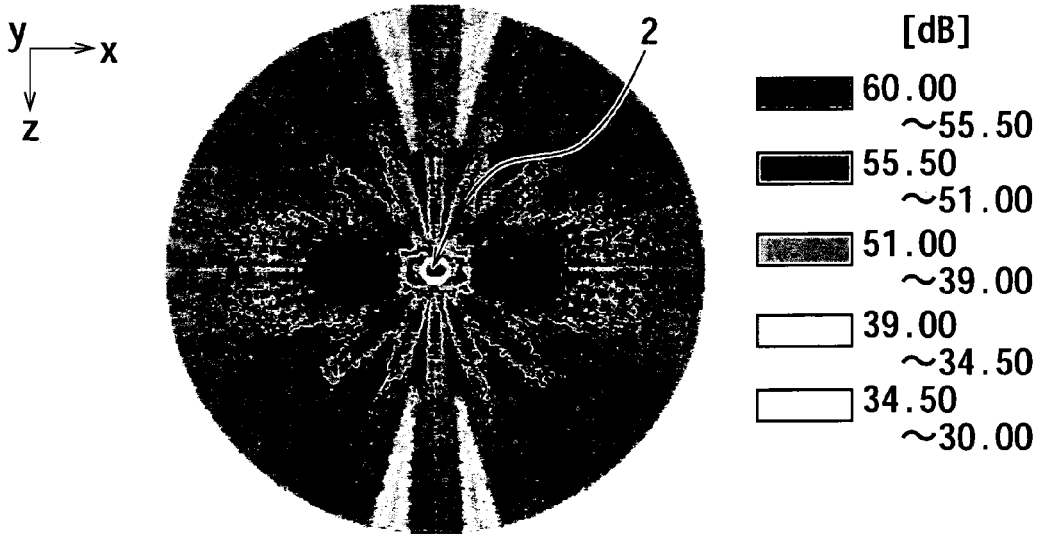
FIG. 11 is a schematic diagram showing the sound level distribution around the spheroid housing on a zx-plane (Frequency: 10 kHz)
Figure 12:
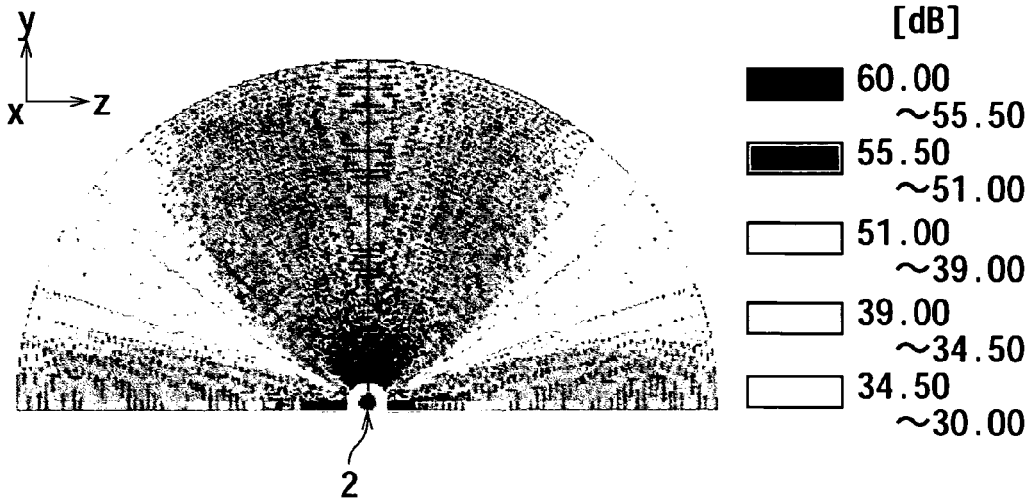
FIG. 12 is a schematic diagram showing the sound level distribution around the spheroid housing on an yz-plane (Frequency: 5 kHz)
Figure 13:
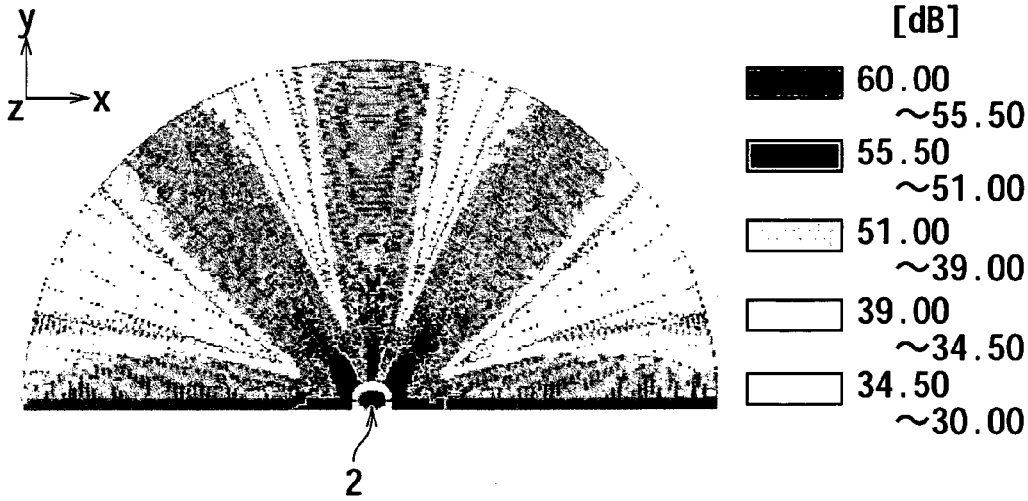
FIG. 13 is a schematic diagram showing the sound level distribution around the spheroid housing on a xy-plane (Frequency: 5 kHz)
Figure 14:
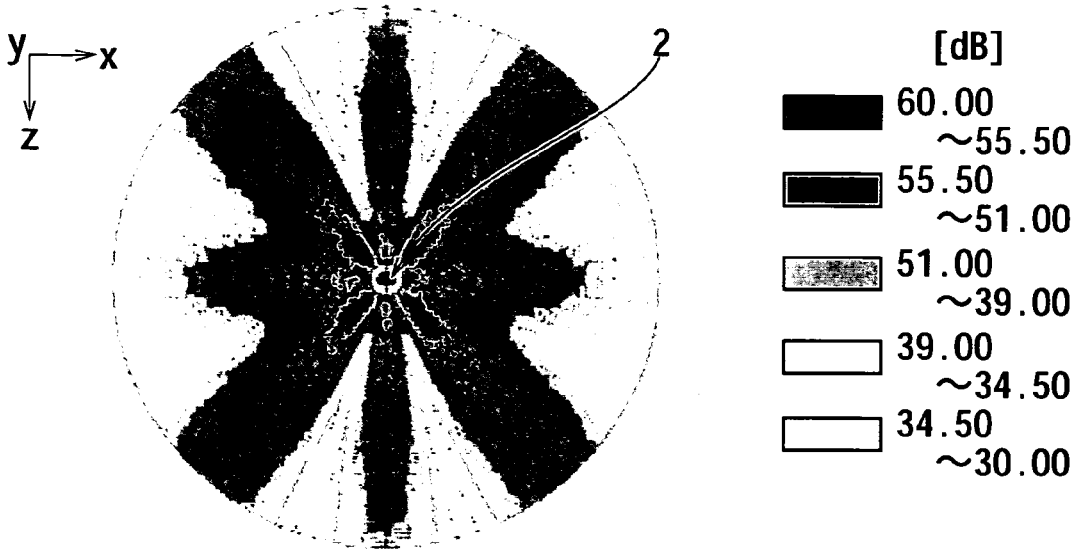
FIG. 14 is a schematic diagram showing the sound level distribution around the spheroid housing on a zx-plane (Frequency: 5 kHz)
Figure 15:
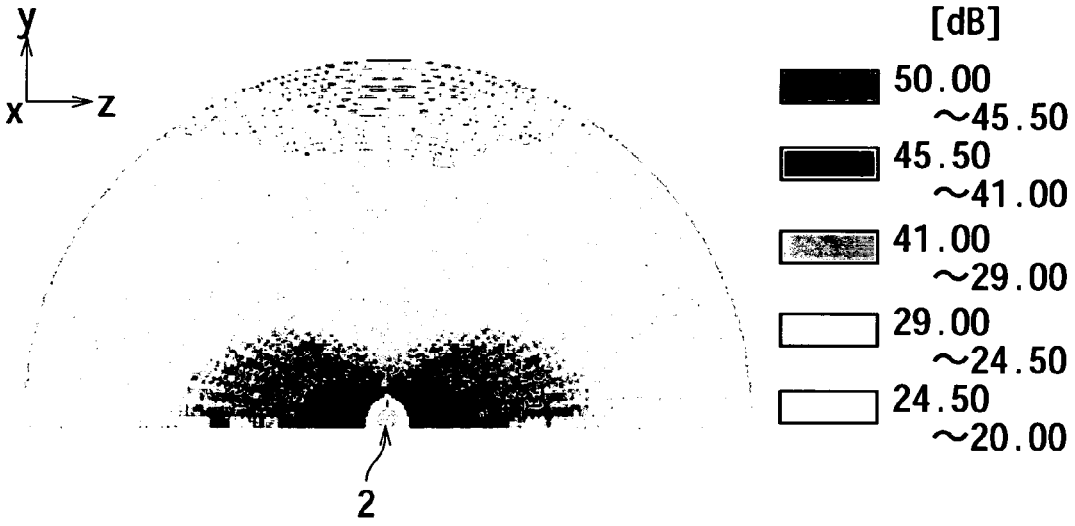
FIG. 15 is a schematic diagram showing the sound level distribution around the spheroid housing on an yz-plane (Frequency: 2 kHz)
Figure 16:
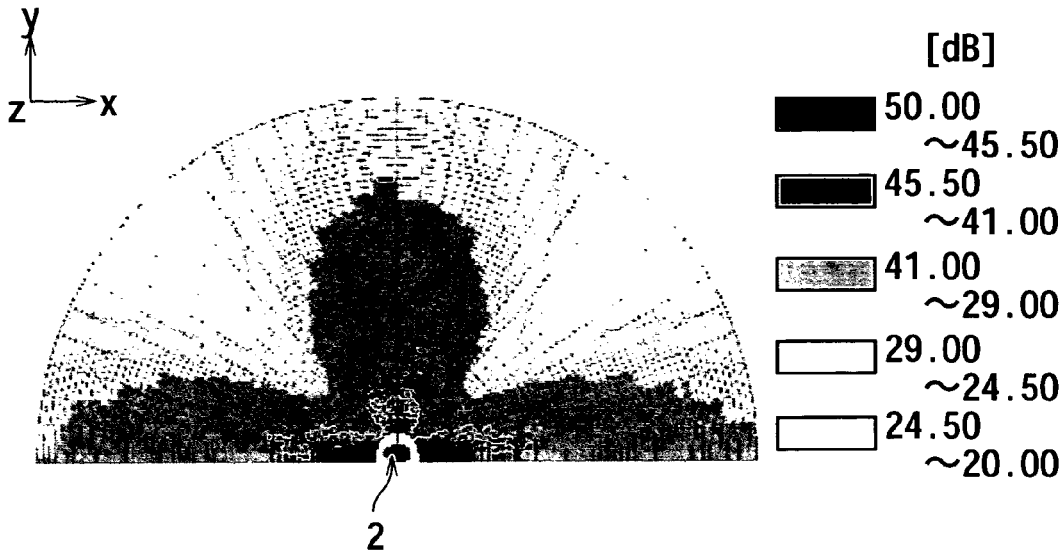
FIG. 16 is a schematic diagram showing the sound level distribution around the spheroid housing on a xy-plane (Frequency: 2 kHz)
Figure 17:
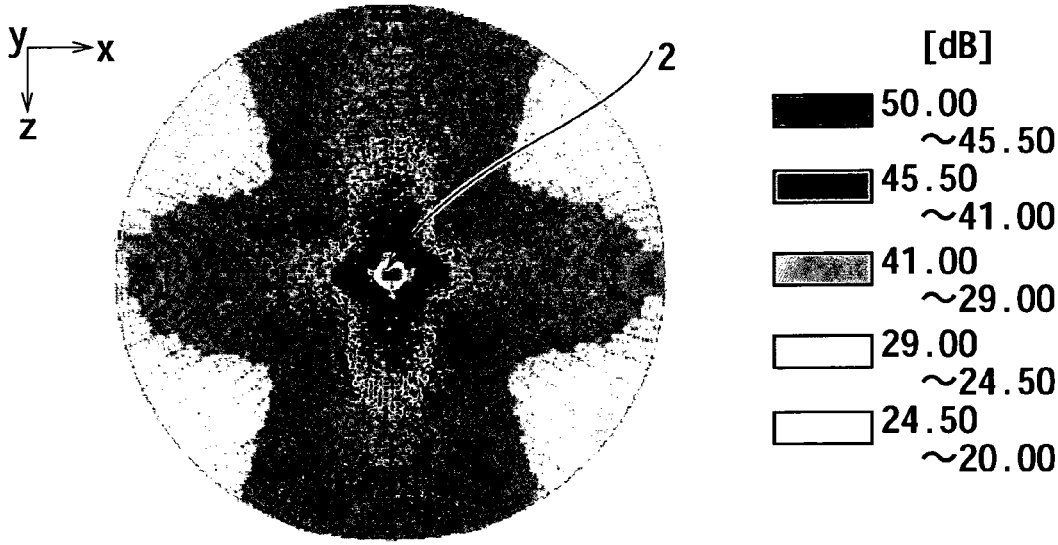
FIG. 17 is a schematic diagram showing the sound level distribution around the spheroid housing on a zx-plane (Frequency: 2 kHz)
Figure 18:
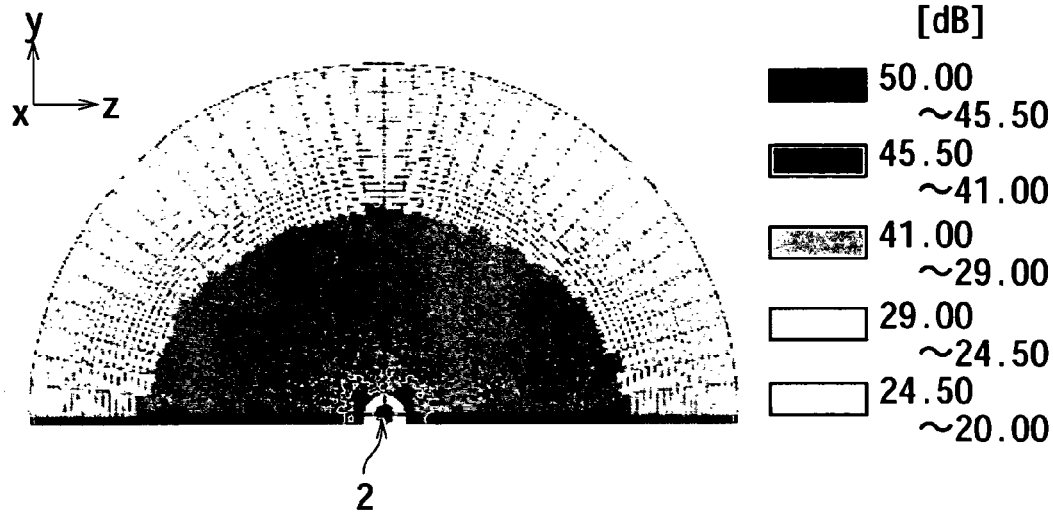
FIG. 18 is a schematic diagram showing the sound level distribution around the spheroid housing on an yz-plane (Frequency: 1 kHz)
Figure 19:
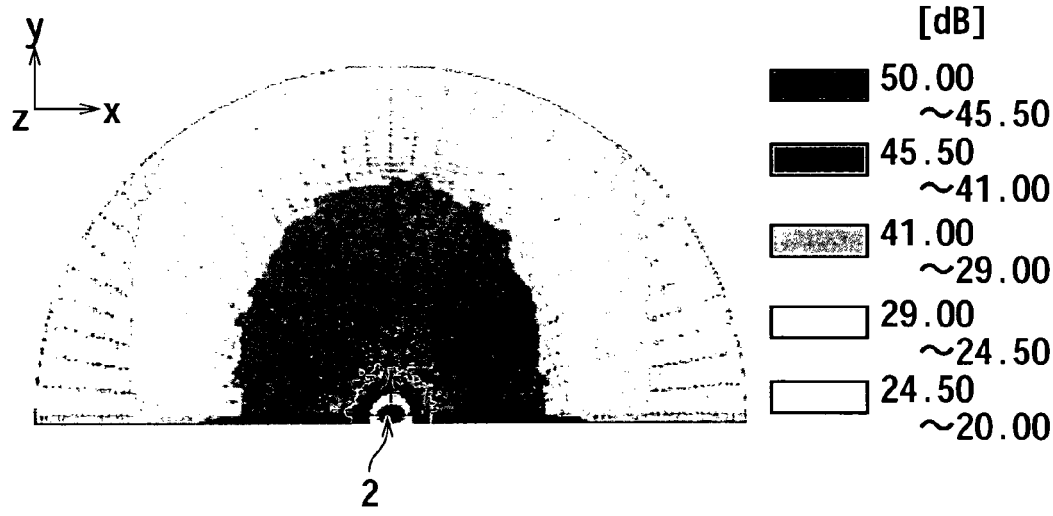
FIG. 19 is a schematic diagram showing the sound level distribution around the spheroid housing on a xy-plane (Frequency: 1 kHz)
Figure 20:
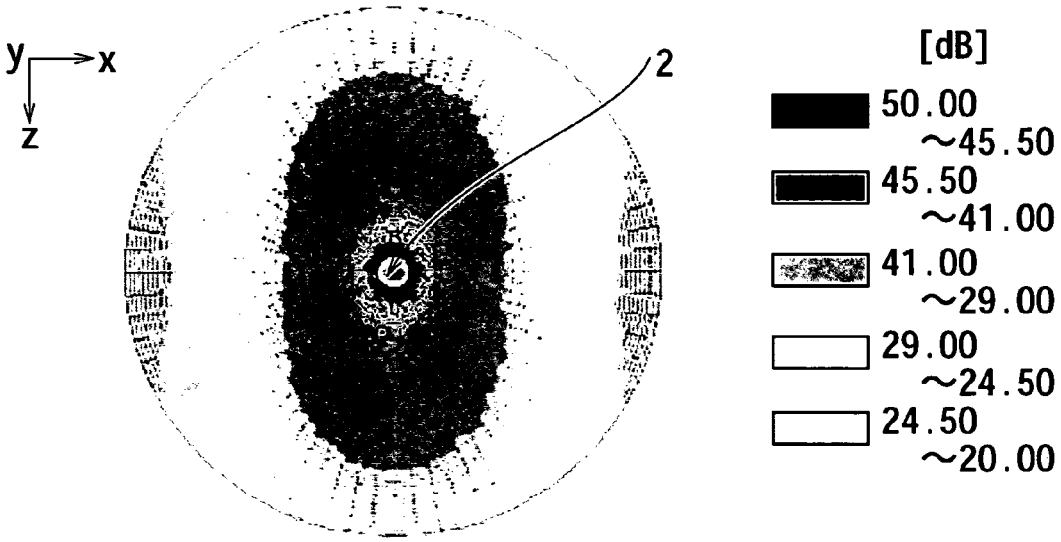
FIG. 20 is a schematic diagram showing the sound level distribution around the spheroid housing on a zx-plane (Frequency: 1 kHz)
Figure 21:
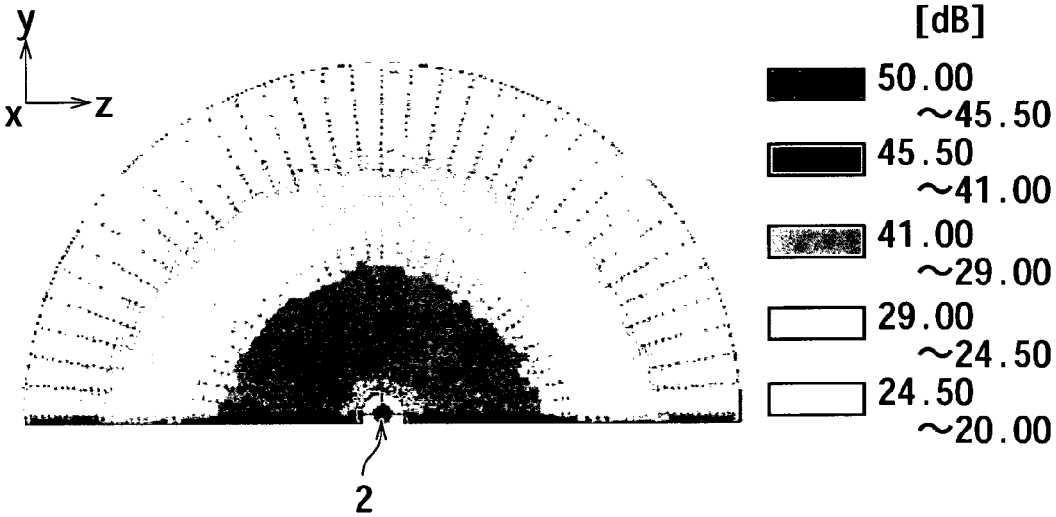
FIG. 21 is a schematic diagram showing the sound level distribution around the spheroid housing on an yz-plane (Frequency: 500 Hz)
Figure 22:
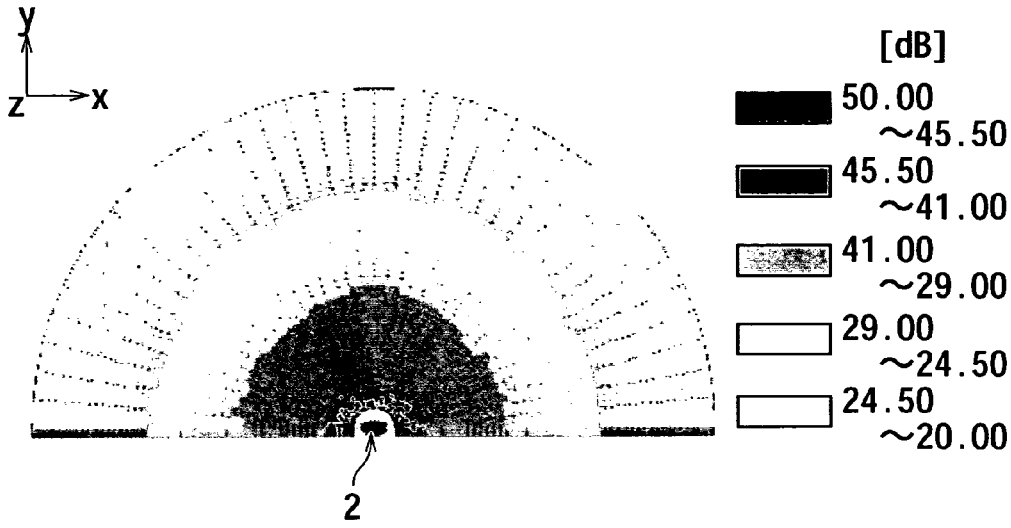
FIG. 22 is a schematic diagram showing the sound level distribution around the spheroid housing on an xy-plane (Frequency: 500 Hz)
Figure 23:
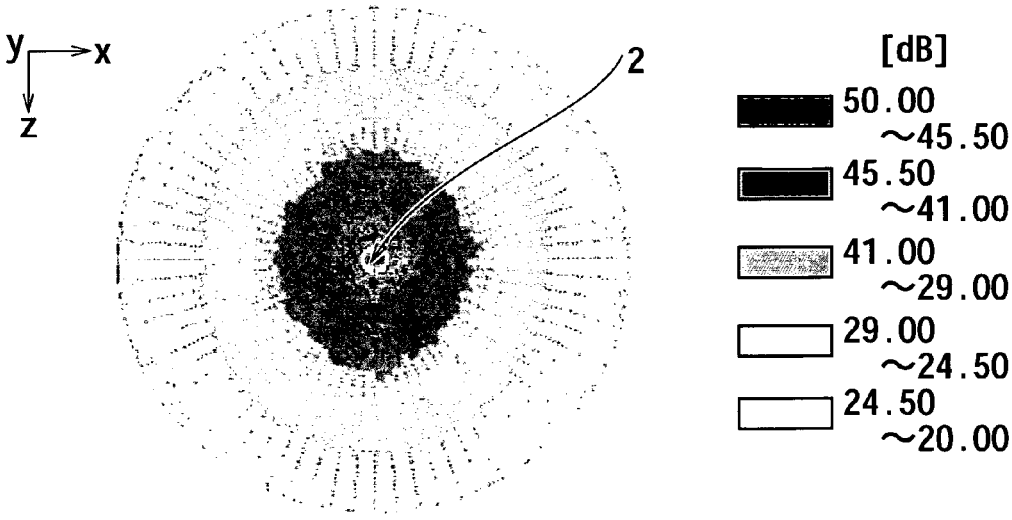
FIG. 23 is a schematic diagram showing the sound level distribution around the spheroid housing on a zx-plane (Frequency: 500 Hz)
Figure 24:
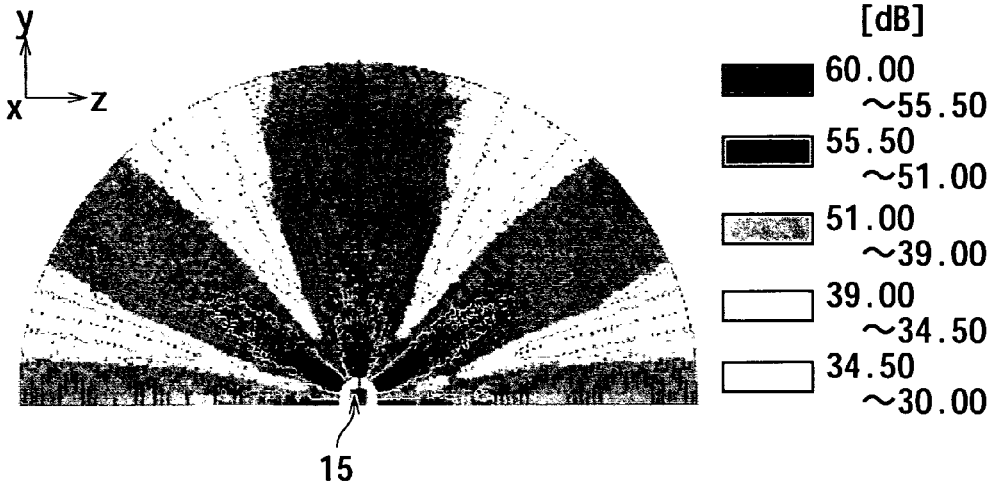
FIG. 24 is a schematic diagram showing the sound level distribution around a rectangular parallelepiped housing on an yz-plane (Frequency: 10 kHz)
Figure 25:
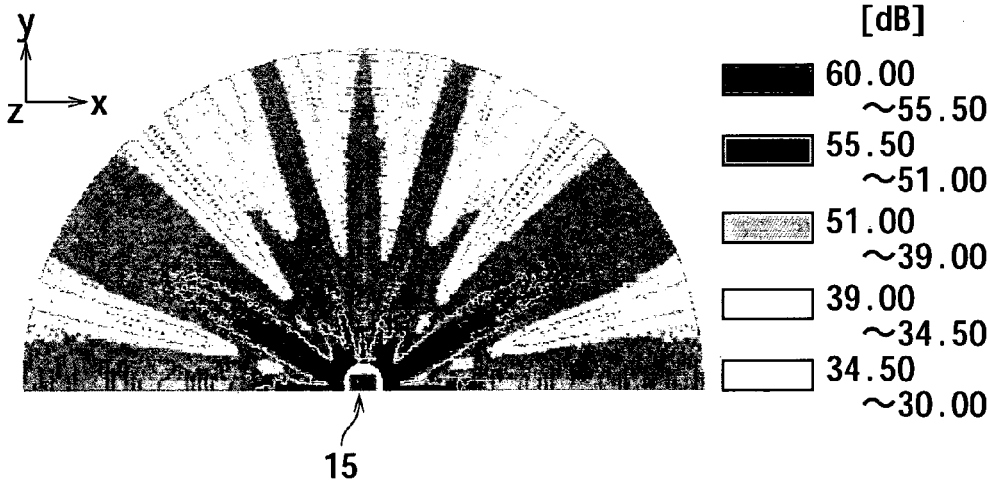
FIG. 25 is a schematic diagram showing the sound level distribution around the rectangular parallelepiped housing on a xy-plane (Frequency: 10 kHz)
Figure 26:
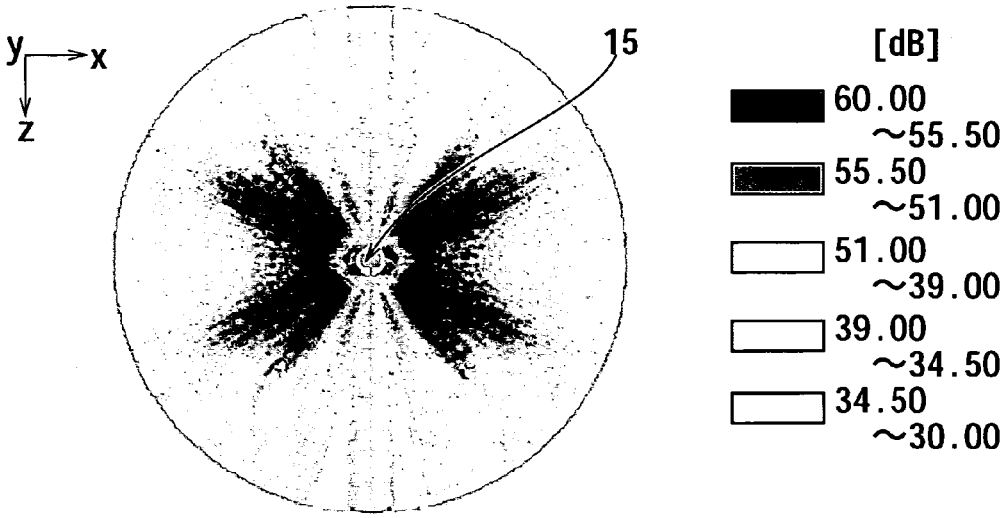
FIG. 26 is a schematic diagram showing the sound level distribution around the rectangular parallelepiped housing on a zx-plane (Frequency: 10 kHz)
Figure 27:
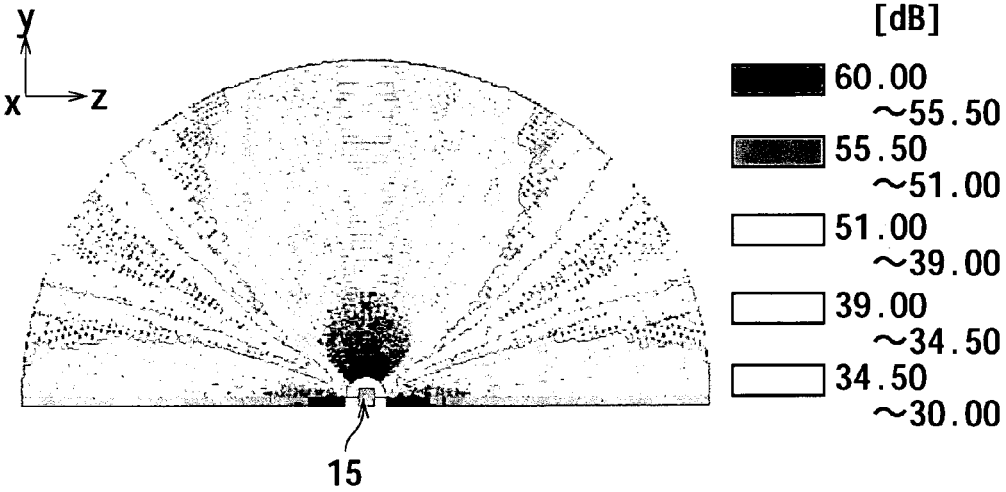
FIG. 27 is a schematic diagram showing the sound level distribution around the rectangular parallelepiped housing on an yz-plane (Frequency: 5 kHz)
Figure 28:
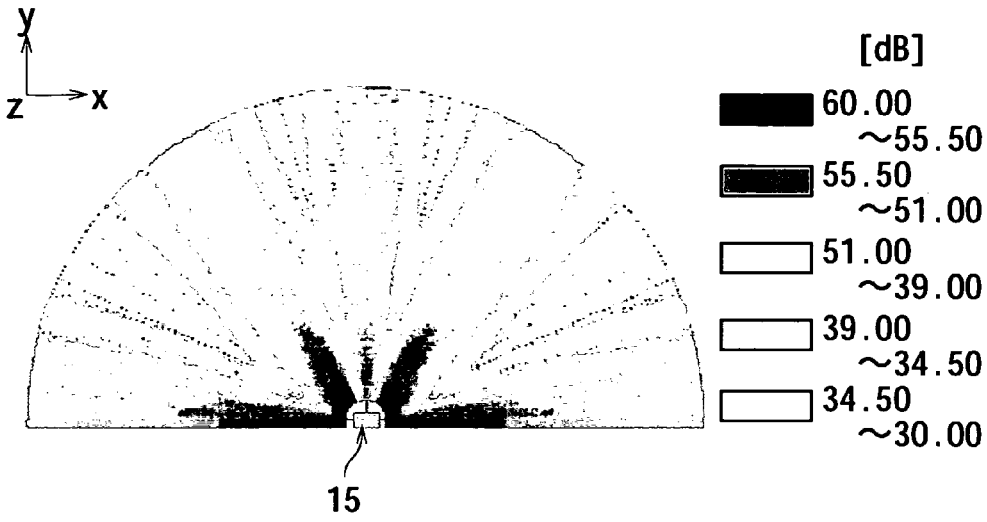
FIG. 28 is a schematic diagram showing the sound level distribution around the rectangular parallelepiped housing on a xy-plane (Frequency: 5 kHz)
Figure 29:
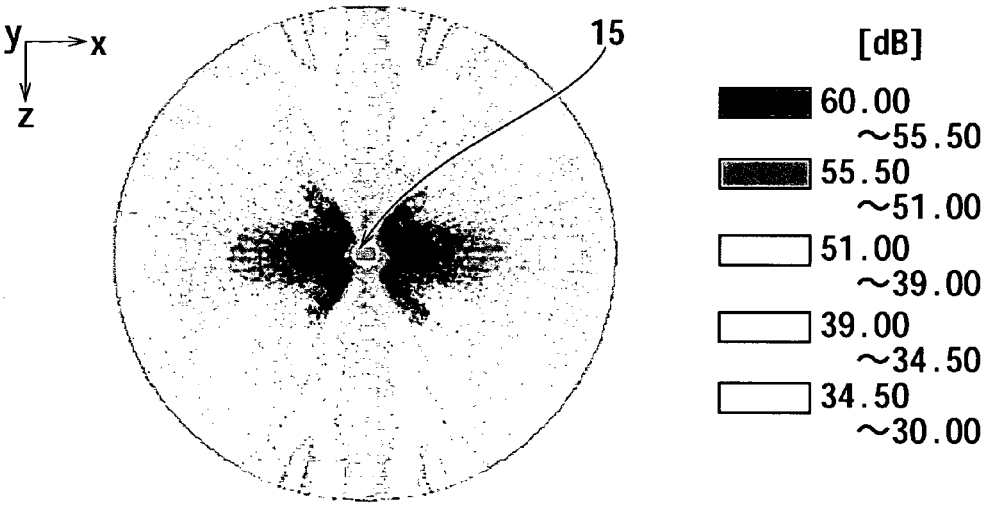
FIG. 29 is a schematic diagram showing the sound level distribution around the rectangular parallelepiped housing on a zx-plane (Frequency: 5 kHz)
Figure 30:
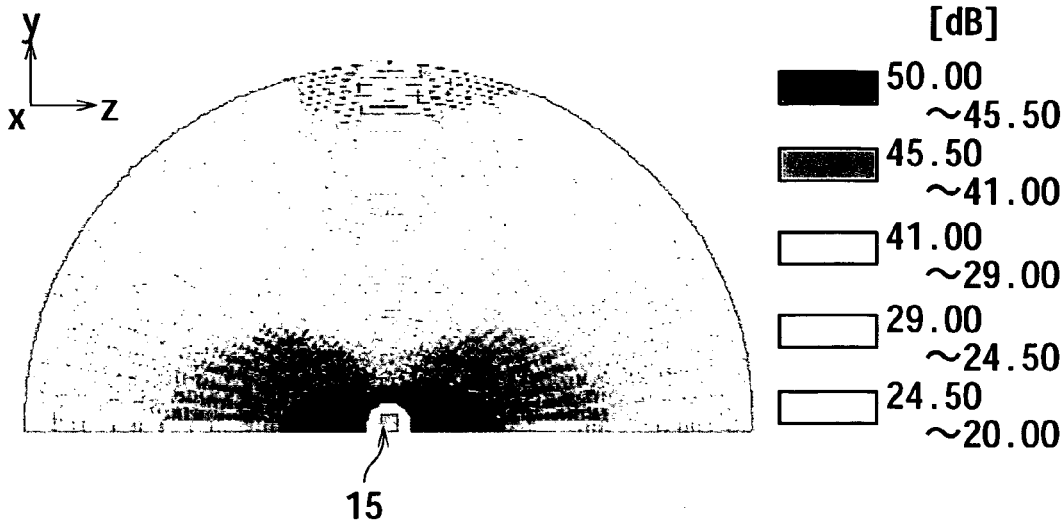
FIG. 30 is a schematic diagram showing the sound level distribution around the rectangular parallelepiped housing on an yz-plane (Frequency: 2 kHz)
Figure 31:
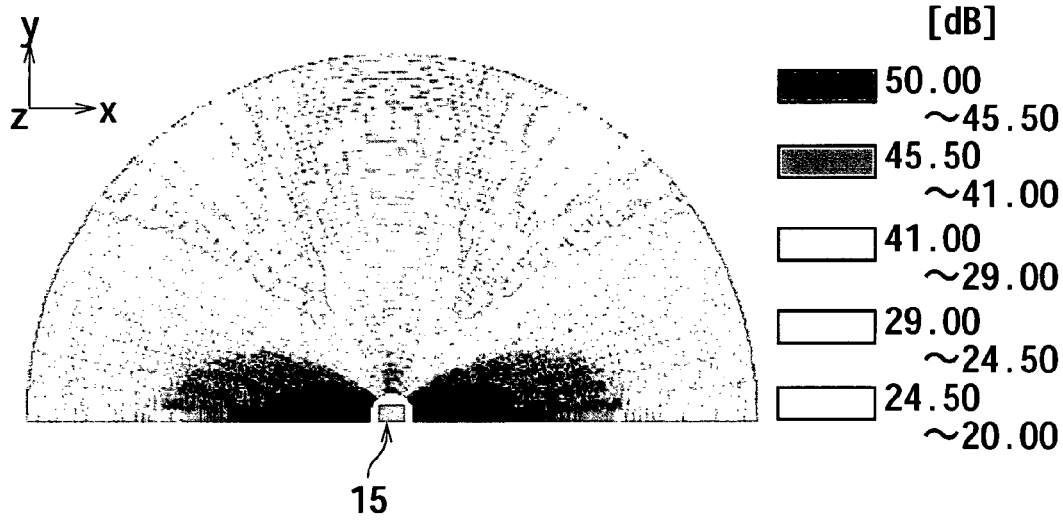
FIG. 31 is a schematic diagram showing the sound level distribution around the rectangular parallelepiped housing on an xy-plane (Frequency: 2 kHz)
Figure 32:
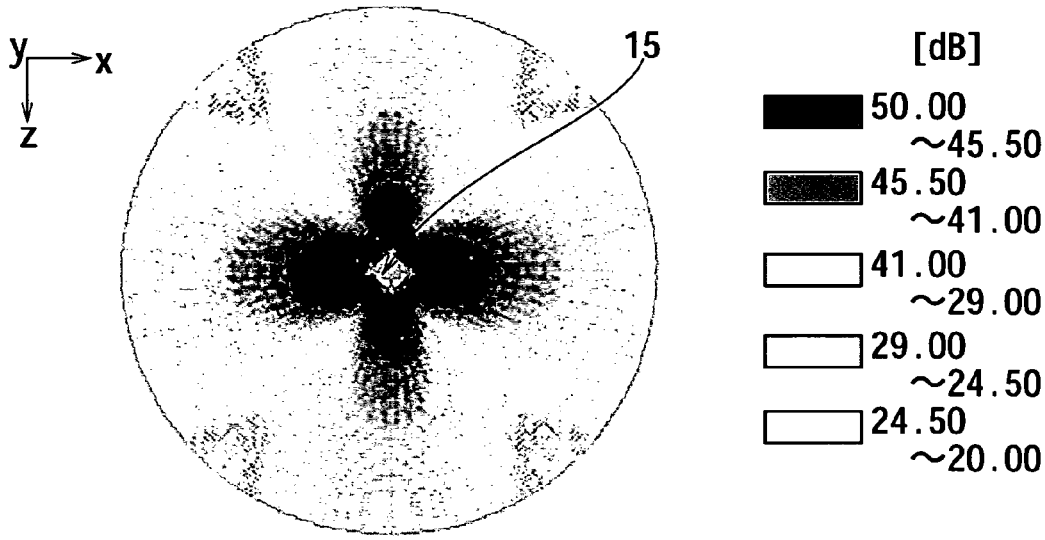
FIG. 32 is a schematic diagram showing the sound level distribution around the rectangular parallelepiped housing on a zx-plane (Frequency: 2 kHz)
Figure 33:
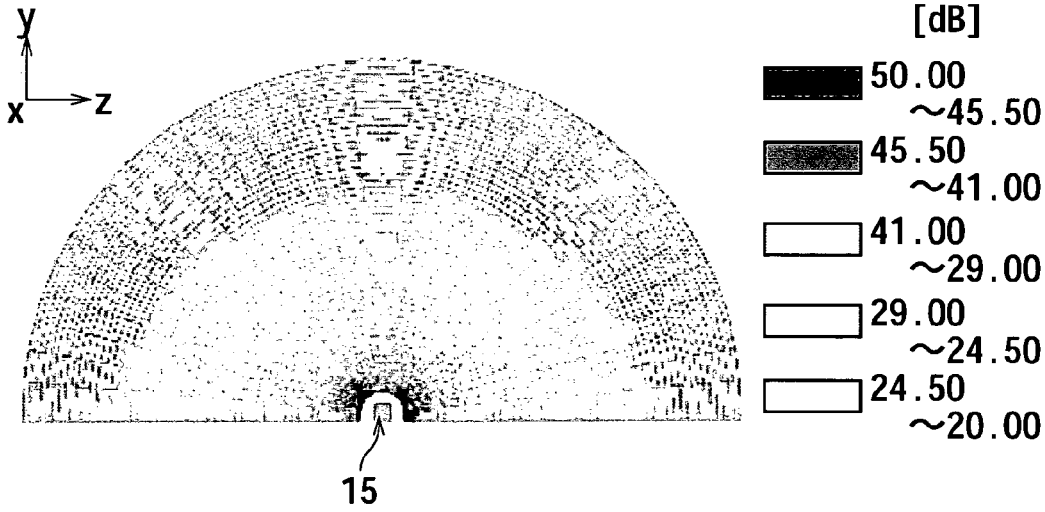
FIG. 33 is a schematic diagram showing the sound level distribution around the rectangular parallelepiped housing on an yz-plane (Frequency: 1 kHz)
Figure 34:
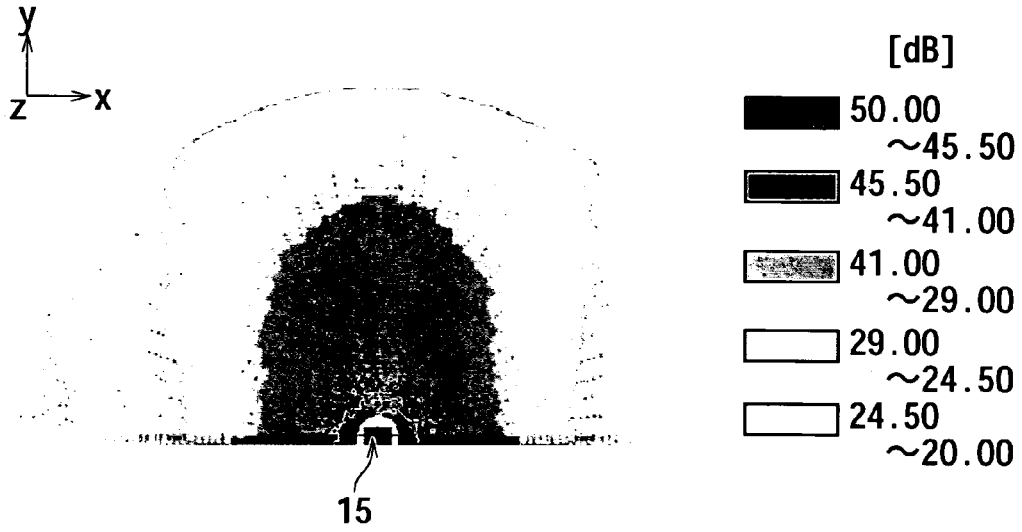
FIG. 34 is a schematic diagram showing the sound level distribution around the rectangular parallelepiped housing on a xy-plane (Frequency: 1 kHz)
Figure 35:
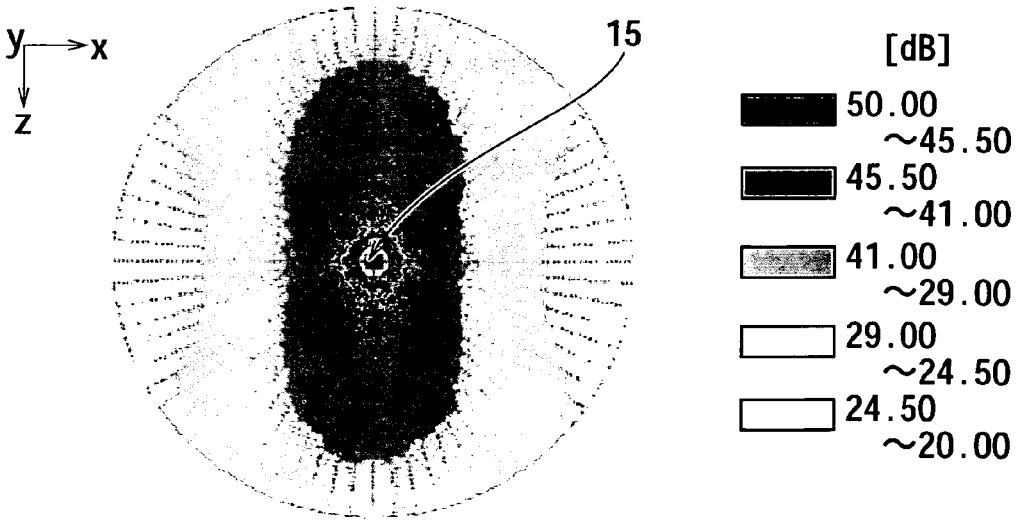
FIG. 35 is a schematic diagram showing the sound level distribution around the rectangular parallelepiped housing on a zx-plane (Frequency: 1 kHz)
Figure 36:
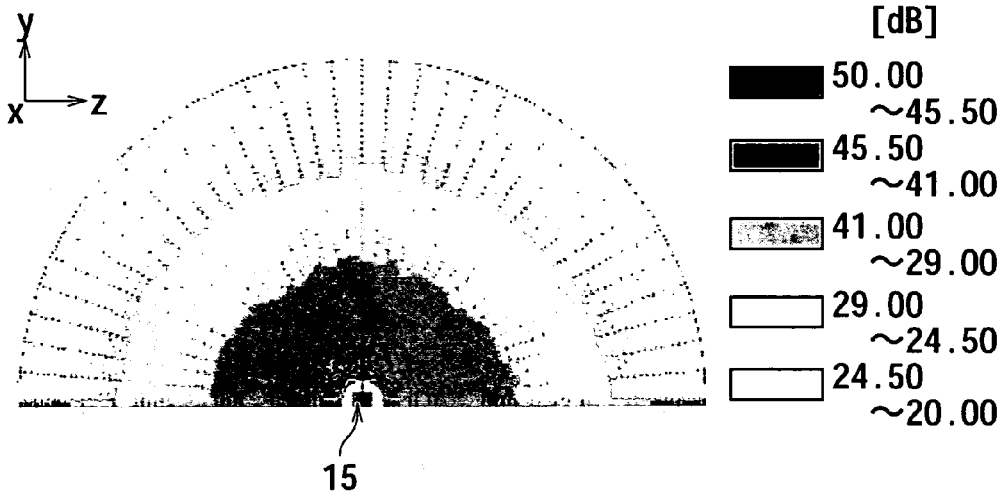
FIG. 36 is a schematic diagram showing the sound level distribution around the rectangular parallelepiped housing on an yz-plane (Frequency: 500 Hz)
Figure 37:
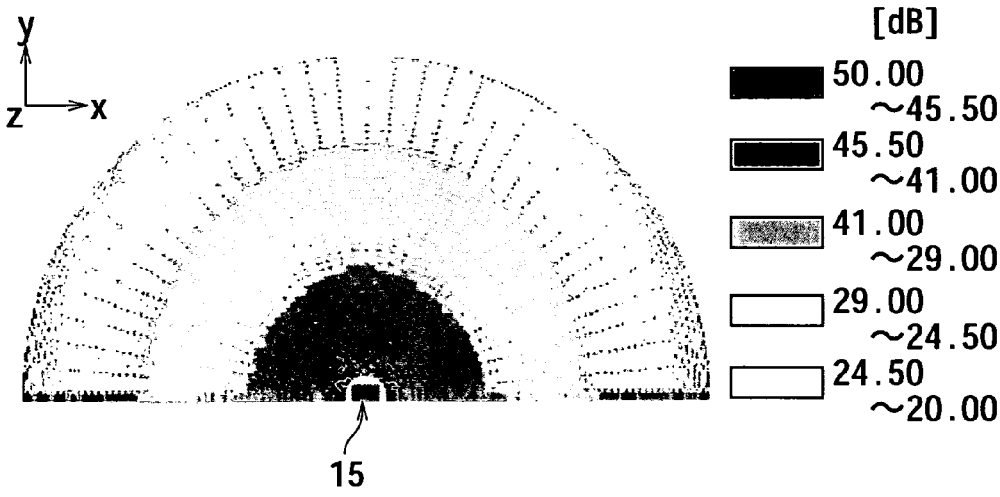
FIG. 37 is a schematic diagram showing the sound level distribution around the rectangular parallelepiped housing on a xy-plane (Frequency: 500 Hz)
Figure 38:
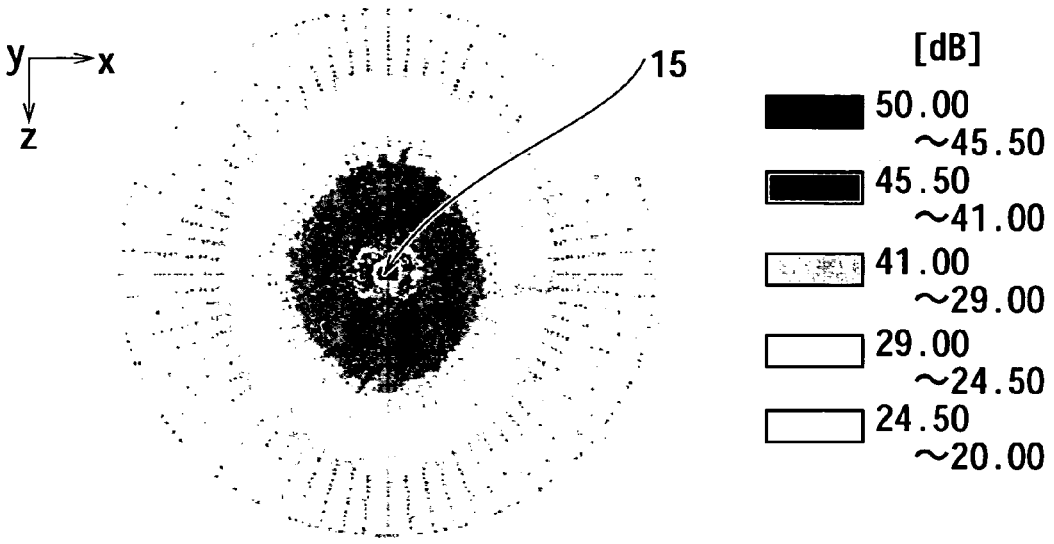
FIG. 38 is a schematic diagram showing the sound level distribution around the rectangular parallelepiped housing on a zx-plane (Frequency: 500 Hz)

FIGS. 3A and 3B show the dimensions of the stereophonic speaker device 1 in this measurement: the length of the long axis of the spheroid housing 2 (i.e. the length between its left end and its right end) is 94 mm; the length between the left end of the central housing section 3 and the right end of the central housing section 3 (i.e. the length between the left-hand aperture 3A and the right-hand aperture 3B) is 82.8 mm; the length between the outermost point of the left-hand housing supporting member 6A and the outermost point of the right-hand housing supporting member 6B is 26.5 mm; the width of the left-hand housing supporting member 6A and right-hand housing supporting member 6B is 3.5 mm; the outer diameter of the left-hand housing supporting member 6A and right-hand housing supporting member 6B is 63 mm; the maximum outer diameter of the vertical section of the central housing section 3 is 59.2 mm; and the diameter of the diaphragms of the left speaker 5A and right speaker 5B is 25 mm. For ease of explanation, the direction from the left end of the spheroid housing 2 to its right end will be specified as an x direction, the direction from its bottom end to its top end will be specified as a y direction, and the direction from its back face to its front face will be specified as a z direction.

In addition, the measurements of sound level distribution have been conducted at each of different frequencies (10 kHz, 5 kHz, 2 kHz, 1 kHz, and 500 Hz). In this case, the level of the left-channel audio signal, which is supplied to the left speaker 5A, is the same as that of the right-channel audio signal, which is supplied to the right speaker 5B. In addition, the left-channel audio signal is in phase with the right-channel audio signal.

FIGS. 4 to 8 show the sound level distributions on the surface of the spheroid housing 2 at each frequency. FIGS. 4, 5, 6, 7, and 8 show the results of 10 kHz, 5 kHz, 2 kHz, 1 kHz, and 500 Hz, respectively.

As shown in FIGS. 4 to 8, on the left end and right end of the spheroid housing 2, which are respectively adjacent to the left speaker 5A and the right speaker 5B, is the maximum sound level (dB) every frequency. In addition, the sound level is gradually attenuated from the left end to its central part and the right end to the central part every frequency. Therefore, it is seen that the stereophonic speaker device 1 improves the quality of sound because the diffraction effect on the surface of the spheroid housing 2 is depressed. Furthermore, the sound level is gradually attenuated in the y direction (i.e. in the direction from the bottom end of the spheroid housing 2 to its top end) every frequency. In this manner, on the bottom side of the spheroid housing 2 is higher sound level. This is because the stereophonic speaker device 1 measured is placed on for example a table, and that causes the baffle effect. That is to say, the reflections from the table are in phase with the direct sound from the left speaker 5A and right speaker 5B, enhancing the direct sound (the reflections are generated by the sound from the left speaker 5A and right speaker 5B reflecting off the table, and the direct sound is the one not reflected off the table). Especially, the baffle effect appears at the low-frequency range where sound waves are relatively longer.

FIGS. 9 to 23 show the sound level distributions around the spheroid housing 2 at each frequency (10 kHz, 5 kHz, 2 kHz, 1 kHz, and 500 Hz). Specifically, FIGS. 9 to 23 show the sound level distributions around the spheroid housing 2 on the yz-plane, xy-plane and zx-plane.

As shown in FIGS. 9 to 23, in the low frequency range (500 Hz) and the middle frequency range (1 kHz and 2 kHz), around the spheroid housing 2 is the maximum sound level. The sound level is gradually attenuated with distance from the spheroid housing 2 in every direction in the same manner. In the high frequency range (5 kHz and 10 kHz), there are some areas where sound level becomes high in the form of a line, but in general, around the spheroid housing 2 is the maximum sound level, and the sound level is gradually attenuated with distance from the spheroid housing 2. The areas where sound level is high in the form of a line, which show beam-like directional characteristics of sound, may be caused by the interference between sounds from the left speaker 5A and the right speaker 5B. In this regard, with the high frequency range, each of the beam-like areas where sound level is high extends from the spheroid housing 2 to each direction without inclining toward a certain direction.

Accordingly, with this spheroid housing 2, the left speaker 5A and the right speaker 5B are approximately equivalent to a point sound source. That is to say, the left speaker 5A and the right speaker 5B works like a non-directional sound source. Therefore, the stereophonic sound from the left speaker 5A and the right speaker 5B smoothly radiates from the spheroid housing 2 in every direction. In addition, since the left speaker 5A is very close to the right speaker 5B, the sound from the left speaker 5A and the sound from the right speaker 5B reach a listener at substantially the same sound level and the same time, even if he/she does not stand in front of the diaphragm of the left speaker 5A or the right speaker 5B (or, he/she stands in front of the stereophonic speaker device 1). Therefore, with the stereophonic speaker device 1, the listening area is not limited to a certain range. The listener can have good quality of stereophonic sound from anywhere around the stereophonic speaker device 1.

FIGS. 24 to 38 show the sound level distribution around a housing 15 to compare with the sound level distribution of the stereophonic speaker device 1 according to an embodiment of the present invention. In this case, the housing 15 is substantially in the shape of a rectangular parallelepiped, while the stereophonic speaker device 1 is substantially in the shape of a spheroid (The housing 15 will be also referred to as a rectangular parallelepiped housing 15). By the way, the longitudinal length of the rectangular parallelepiped hosing 15 (i.e. the length between its one end to its other end in a longitudinal direction) is 94 mm, which is almost the same as the length between the left end of the spheroid housing 2 and its right end; and the length of one side of the side surfaces, which are in the shape of a square, of the rectangular parallelepiped hosing 15 is 59.2 mm, which is almost the same as the maximum outer diameter of the vertical section of the central housing section 3 of the spheroid housing 2 (59.2 mm). A left speaker and a right speaker, which are the same as the left speaker 5A and right speaker 5B of the spheroid housing 2, are respectively disposed at the left end and right end of the rectangular parallelepiped housing 15 such that the front faces of the diaphragms of the left speaker and right speaker are exposed outside. For ease of explanation, the direction from the one end of the rectangular parallelepiped housing 15 to its other end will be specified as an x direction, the direction from its bottom end to its top end will be specified as a y direction, and the direction from its back face to its front face will be specified as a z direction.

In addition, the measurements of sound level distribution have been conducted at each of different frequencies (10 kHz, 5 kHz, 2 kHz, 1 kHz, and 500 Hz). FIGS. 24 to 38 show the sound level distributions around the rectangular parallelepiped housing 15 at each frequency, and specifically show the sound level distributions around the rectangular parallelepiped housing 15 on the yz-plane, xy-plane and zx-plane.

As shown in FIGS. 24 to 38, in the low frequency range (500 Hz), there is little difference on the sound level distributions between the rectangular parallelepiped housing 15 and the spheroid housing 2. This is because, compared to the wave length of the sound, the size of the left speaker, right speaker and housing is very small and the distance between the left speaker and the right speaker and the like are also small. The same could be said for the spheroid housing 2. However, as the frequency increases from the middle frequency range (1 kHz and 2 kHz) to the high frequency range (5 kHz and 10 kHz), the number of beam-like areas where sound level is high increases (i.e. the beam-like directional characteristics of sound distinctly appear). In addition, in the middle frequency range and the high frequency range, the beam-like areas extended from the rectangular parallelepiped housing 15 incline toward certain directions. This distribution is different from that of the spheroid housing 2. That is to say, since the rectangular parallelepiped housing 15 has corners on its surface, the sound from the left speaker and the sound from the right speaker enhance or cancel each other around the corners of the rectangular parallelepiped housing 15. This produces the beam-like characteristics of sound in certain directions. Therefore, the stereophonic sound from the left speaker and the right speaker does not radiate from the rectangular parallelepiped housing 15 in every direction. Thus, with the rectangular parallelepiped housing 15, the listening area is limited to a certain range.

As described above, the stereophonic speaker device 1 has the spheroid housing 2, which is hollow and in the shape of a spheroid. On the one end (left end) and other end (right end) of the long side of the spheroid housing 2, the left speaker 5A and the right speaker 5B are disposed such that the front faces of the diaphragms of the left speaker 5A and right speaker 5B face outwardly. That is to say, the stereophonic speaker device 1 has a hemispheroid baffle with a smoothly curved surface that extends from the edge of the diaphragm of the left speaker 5A to the rear of this diaphragm; and a hemispheroid baffle with a smoothly curved surface that extends from the edge of the diaphragm of the right speaker 5B to the rear of this diaphragm. In this stereophonic speaker device 1, the baffles of the left speaker 5A and right speaker 5B are connected to each other in a seamless manner. That prevents the sound from the left speaker 5A and the right speaker 5B from being diffracted on the surface of the spheroid housing 2. Thus, the sound from the left speaker 5A and the right speaker 5B smoothly radiates from the spheroid housing 2 in every direction.

In addition, in the stereophonic speaker device 1, the ring-shaped left-hand housing supporting member 6A is provided around the outer circumference of the spheroid housing 2 such that the left-hand housing supporting member 6A protrudes a little from the spheroid housing 2. In the same way, the ring-shaped right-hand housing supporting member 6B is provided around the outer circumference of the spheroid housing 2 such that the right-hand housing supporting member 6B protrudes a little from the spheroid housing 2. When the stereophonic speaker device 1 is placed on a plane such as a surface of a table, one spot of the left-hand housing supporting member 6A and one spot of the right-hand housing supporting member 6B touch the plane. Therefore, the spheroid housing 2 is supported a little above the plane by the left-hand housing supporting member 6A and the right-hand housing supporting member 6B. This makes a contact area between the plane and the stereophonic speaker device 1 as small as possible. Thus, a large amount of vibration from the spheroid housing 2 does not get into the plane.

Furthermore, since the spheroid housing 2 is supported a little above the plane by the left-hand housing supporting member 6A and the right-hand housing supporting member 6B, the diaphragms of the left speaker 5A and right speaker 5B do not touch the plane but are very close to the plane. This enhances sound (especially low-pitched sound) from the left speaker 5A and the right speaker 5B due to the baffle effect. Accordingly, even if speakers of the stereophonic speaker device 1 are small and do not have good capability of reproducing sound at low frequencies, the baffle effect helps the stereophonic speaker device 1 improve the quality of sound at low frequencies. Therefore, the speakers of the stereophonic speaker device 1 can be small while maintaining the quality of sound.

As described above, the stereophonic speaker device 1 includes; the spheroid housing 2 in the shape of a spheroid; the left speaker 5A, which is attached to the left end of the long side of the spheroid housing 2 such that the front face of the diaphragm faces outwardly of the spheroid housing 2; and the right speaker 5B, which is attached to the right end of the long side of the spheroid housing 2 such that the front face of the diaphragm faces outwardly of the spheroid housing 2. Therefore, the left speaker 5A and the right speaker 5B are approximately equivalent to a point sound source, and the sound from the left speaker 5A and the right speaker 5B smoothly radiates from the spheroid housing 2 in every direction. Thus, a listener can have good quality of sound from anywhere around the spheroid housing 2.

(4) Other Embodiments

In the above-noted embodiments, the housing of the stereophonic speaker device 1 is in the shape of a spheroid. However, the present invention is not limited to this. When viewed in the front-back direction (i.e. in the z direction and a direction opposite to the z direction), the housing may be in the shape of a circle or a prolate ellipsoid instead of an ellipsoid. When viewed in the longitudinal direction (i.e. in the x direction and a direction opposite to the x direction), the housing may be in the shape of an ellipsoid or a prolate ellipsoid instead of a circle. That is to say, it is desirable that the housing of the stereophonic speaker device 1 do not have any corners on its surface. This helps the diaphragms of the left speaker 5A and right speaker 5B smoothly radiate sound in every direction.

Figure 39:
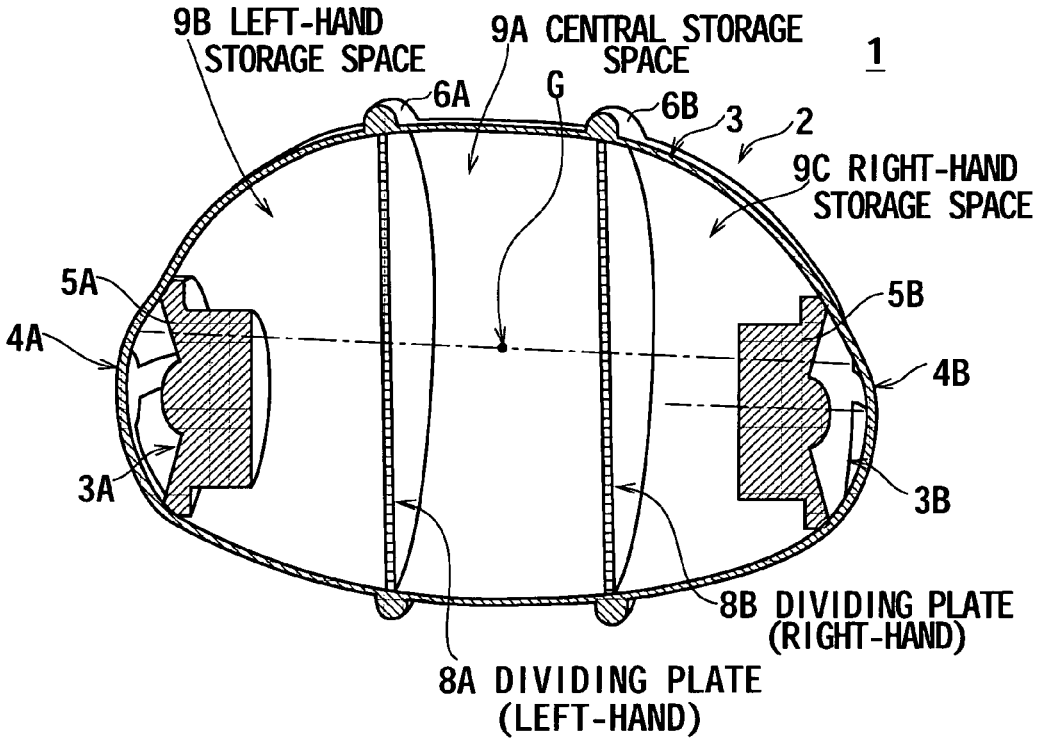
FIG. 39 is a schematic diagram showing the internal structure of a stereophonic speaker device according to another embodiment of the present invention (1)

In the above-noted embodiments, the left speaker 5A (a first speaker) and the right speaker 5B (a second speaker) are attached to the central housing section 3 such that the front faces of the diaphragms of the left speaker 5A and right speaker 5B are respectively exposed outside through the left-hand aperture 3A and the right-hand aperture 3B. In addition, a central axis of the diaphragms of the left speaker 5A and right speaker 5B is substantially in alignment with the housing-central axis of the spheroid housing 2 (the central axis of the diaphragms will be also referred to as a diaphragm-central axis). However, the present invention is not limited to this. The diaphragm-central axis of the left speaker 5A and right speaker 5B may be away from the housing-central axis of the spheroid housing 2 while keeping the diaphragm-central axis parallel to the housing-central axis. For example, as shown in FIG. 39, the diaphragm-central axis of the left speaker 5A and right speaker 5B can be below the housing-central axis of the spheroid housing 2 while keeping the diaphragm-central axis parallel to the housing-central axis. In this case, when the stereophonic speaker device 1 is placed on the plate such as a table, the diaphragms of the left speaker 5A and right speaker 5B are closer to the plate than the above embodiments. This increases the baffle effect.

Figure 40:
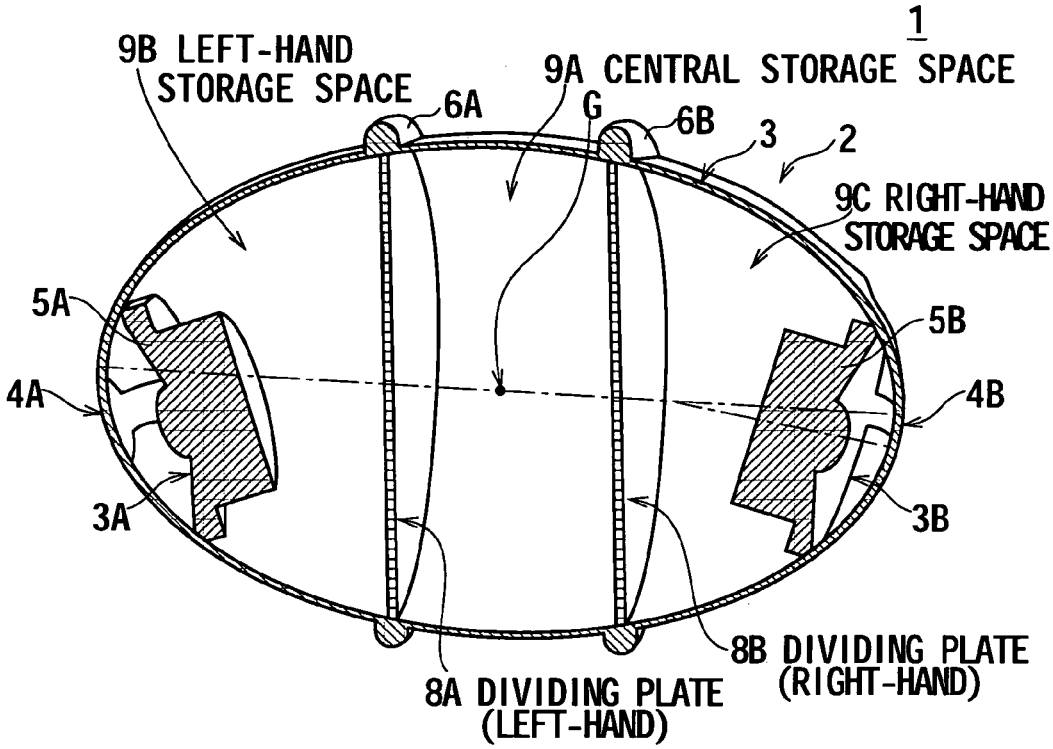
FIG. 40 is a schematic diagram showing the internal structure of a stereophonic speaker device according to another embodiment of the present invention (2)

In addition, the diaphragm-central axis can be inclined with respect to the hosing-central axis. For example, as shown in FIG. 40, the diaphragm-central axis can be inclined at approximately 30 degrees from the hosing-central axis such that the front faces of the diaphragms face down. This increases the amount of the sound reflected off the plane, and therefore increases the baffle effect. In this manner, the diaphragm-central axis may be away from the hosing-central axis; nonetheless, the same effect as the above embodiments can be obtained. Note that it is desirable that the diaphragm of the left speaker 5A and the diaphragm of the right speaker 5B be disposed along the surface of the left-end section of the spheroid housing 2 and the surface of the right-end section of the spheroid housing 2, respectively.

Figure 41:
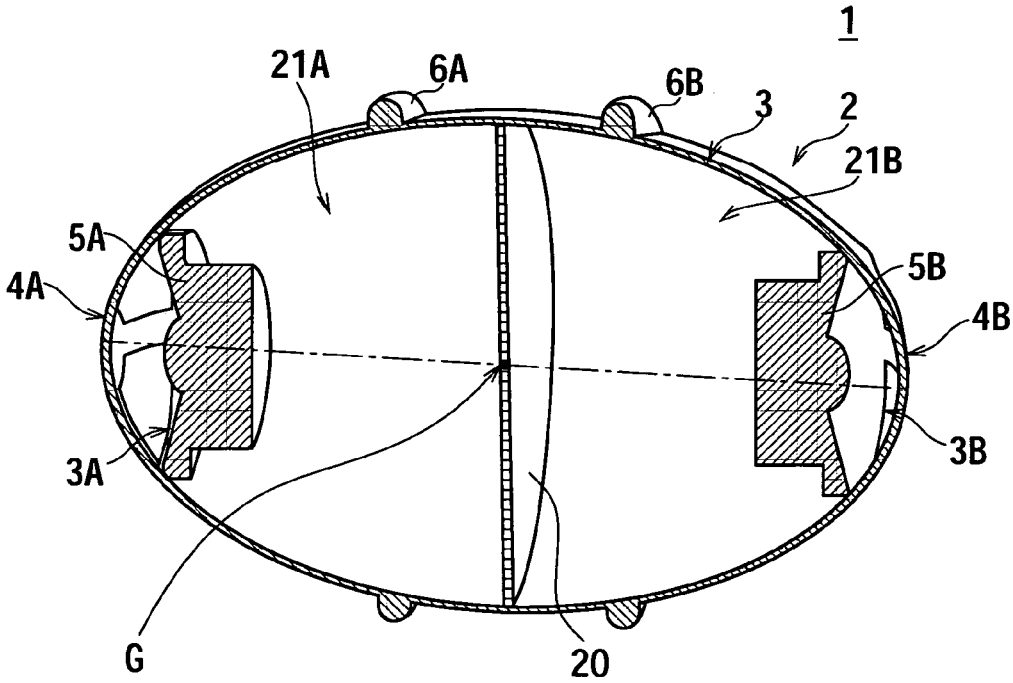
FIG. 41 is a schematic diagram showing the internal structure of a stereophonic speaker device according to another embodiment of the present invention (3)

In the above-noted embodiments, the central housing section 3 has the pair of dividing plates 8A and 8B inside it. These dividing plates 8A and 8B create three spaces inside the central housing section 3. However, the present invention is not limited to this. Only one dividing plate (or three or more dividing plates) may be placed inside the central housing section 3. For example, as shown in FIG. 41, the central housing section 3 may have only one dividing plate 20 inside it. In this case, the dividing plate 20 is on the central point G and perpendicular to the housing-central axis. In the central housing section 3, the dividing plate 20 creates a left-hand storage space 21A, which is on the left side of the dividing plate 20; and a right-hand storage space 21B, which is on the right side of the dividing plate 20 and is the same size as the left-hand storage space 21A. The left speaker 5A is stored in the left-hand storage space 21A, while the right speaker 5A is stored in the right-hand storage space 21B. This configuration can be applied to a stereophonic speaker device that does not include the circuit section 10 such as an amplifier. The stereophonic speaker device with this configuration directly outputs stereophonic audio signals, which are supplied from an external amplifier after being amplified, to the left speaker 5A and the right speaker 5B. In addition, the weight 7 (not shown) for example is divided into two pieces, and each piece is placed in the left-hand storage space 21A and the right-hand storage space 21B.

Figure 42A:
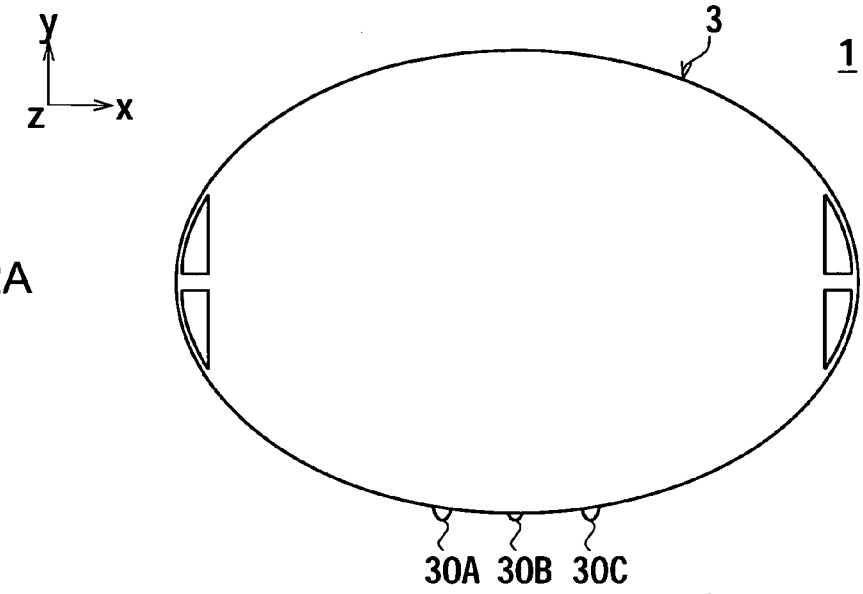
FIGS. 42A and 42B are schematic diagrams showing the configuration of a housing supporting section according to another embodiment of the present invention (1)
Figure 42B:
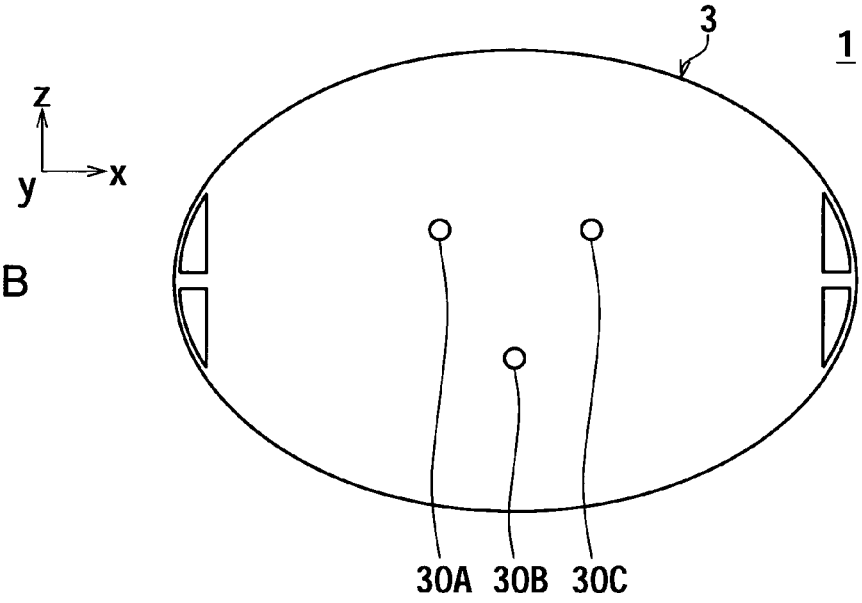
Figure 43A:
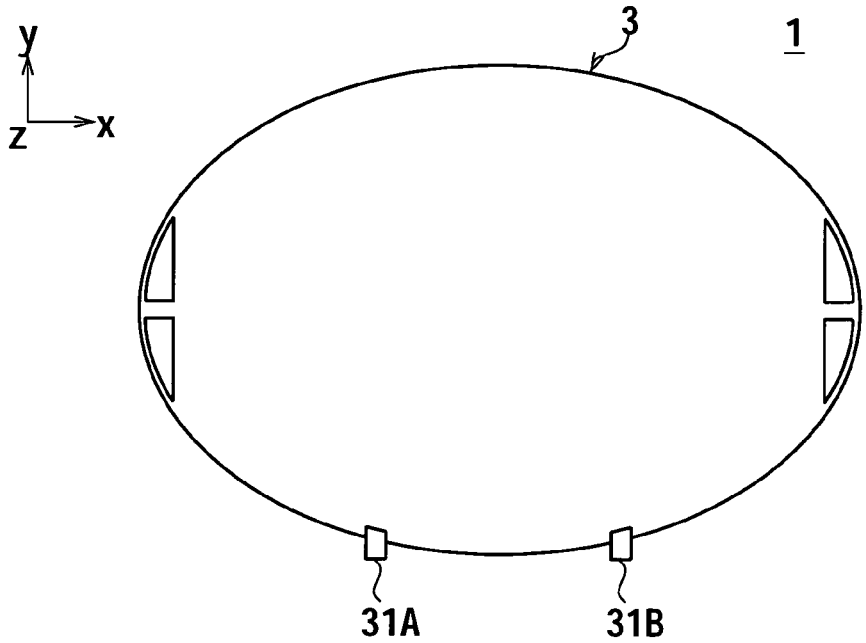
FIGS. 43A and 43B are schematic diagrams showing the configuration of a housing supporting section according to another embodiment of the present invention (2).
Figure 43B:
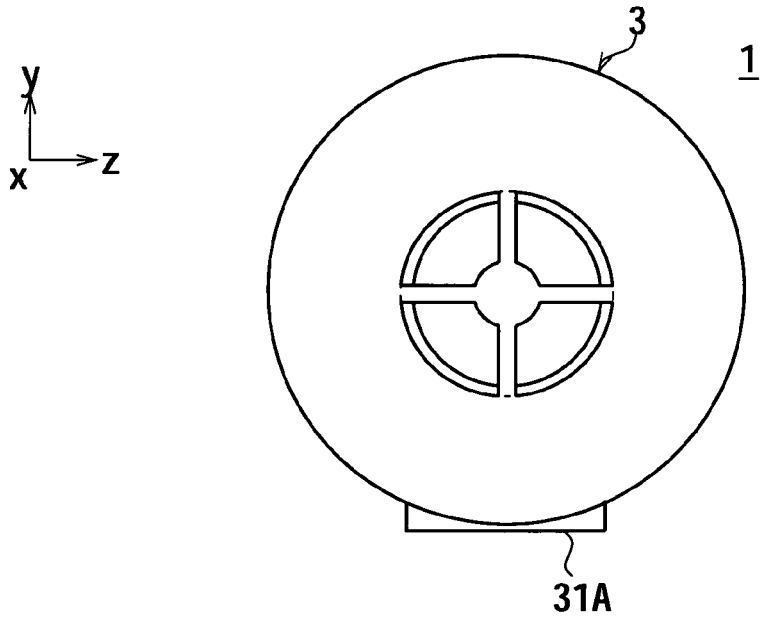

In the above-noted embodiments, the central housing section 3 is supported by the left-hand housing supporting member 6A and the right-hand housing supporting member 6B. This ring-shaped left-hand housing supporting member 6A is provided around the outer circumference of the central housing section 3 such that the left-hand housing supporting member 6A protrudes a little from the central housing section 3. In the same way, the ring-shaped right-hand housing supporting member 6B is provided around the outer circumference of the central housing section 3 such that the right-hand housing supporting member 6B protrudes a little from the central housing section 3. However, the present invention is not limited to this. Differently-shaped supporting sections, which are provided on the central housing section 3 such that they protrude from the central housing section 3, may support the central housing section 3. For example, as shown in FIGS. 42A and 42B, the central housing section 3 may have three supporting sections 30A, 30B and 30C on the bottom face, each of which is in the shape of a hemisphere. In this case, the supporting sections 30A, 30B and 30C are disposed at apexes of an imaginary triangle to support the central housing section 3. Alternatively, as shown in FIGS. 43A and 43B, the central housing section 3 may have two supporting plates 31A and 31B on the bottom face, each of which has a flat bottom face. In this case, these flat bottom faces are going to be parallel to the plane when the central housing section 3 is placed thereon. The supporting plates 31A and 31B therefore support the central housing section 3. In this manner, it is desirable that a supporting section (or supporting sections) that supports the central housing section 3 have at least two small contact areas with the plane and these contact areas be arranged in a line parallel to the housing-central axis. This prevents the stereophonic speaker device from moving while the diaphragms of the left speaker 5A and right speaker 5B are vibrating and emitting sound.

In the above-noted embodiments, the present invention is applied to the stereophonic speaker device 1 with a built-in amplifier. However, the present invention is not limited to this. For example, the present invention may be applied to a reproducing device with built-in stereophonic speakers. In this case, the reproducing device may have the circuit section 10. This circuit section 10 may include a recording device such as a nonvolatile memory and a hard disk drive, which stores audio data compressed and coded in a format such as MPEG Audio Layer-3 (MP3) format and Adaptive Transform Acoustic Coding 3 (ATRAC3) format; and a reproduction processing device, which converts the compressed-coded audio data read from the recording device into audio signals by performing decoding process, digital-to-analog conversion process, amplification process and the like and then supplies the audio signals to the left speaker 5A and the right speaker 5B. Alternatively, the circuit section 10 may include a reception reproduction processing device, which receives audio data from external transmitters through wired means or wireless means (such as infrared communication means), converts the audio data into audio signals by performing demodulation process and the like, and then supplies the audio signals to the left speaker 5A and the right speaker 5B. In this case, modulating and demodulating the audio data may be done in digital or analog format. The explanation about the operation of the circuit section 10, which includes the recording device and the reproduction processing device, or the reception reproduction processing device, is omitted here, because the operation of the circuit section 10 is almost the same as general reproducing apparatus.

In the above-noted embodiments, the present invention is applied to the stereophonic speaker device 1 capable of emitting sound in 2-channel stereo. However, the present invention is not limited to this. For example, the present invention may be also applied to a monophonic speaker device capable of emitting monophonic sound, and the like.

In the above-noted embodiments, the left-end housing section 4A and the right-end housing section 4B, which are substantially in the shape of a dome, are formed by curving a latticed plate which is in the shape of a cruciform. Therefore, the left-end housing section 4A and the right-end housing section 4B work like a speaker grille for protection. However, the present invention is not limited to this. Differently-shaped left-end housing section 4A and right-end housing section 4B can be applied to the stereophonic speaker device 1. Note that it is desirable that the left-end housing section 4A and right-end housing section 4B always work like a speaker grille.

In the above-noted embodiments, the left-hand housing supporting member 6A and the right-hand housing supporting member 6B, which work as shock absorbers, are for example made from elastic materials such as rubber and silicones. However, the present invention is not limited to this. The left-hand housing supporting member 6A and the right-hand housing supporting member 6B may be also made from metal, plastic and the like. Note that it is desirable to make a contact area between the plane where the stereophonic speaker device 1 is placed and the supporting members as small as possible to prevent the vibration of the stereophonic speaker device 1 from getting into the plane.

In the above-noted embodiments, the present invention is for example applied to the stereophonic speaker device 1 with the dimensions (outer circumferences) shown in FIGS. 3A and 3B. However, the present invention is not limited to this. The present invention may be also applied to the stereophonic speaker device 1 with different dimensions (outer circumferences).

The configuration and method according to an embodiment of the present invention can be applied to various kinds of speaker devices and reproducing devices (such as a speaker device capable of emitting stereophonic sound, and a reproducing device capable of receiving and reproducing audio data with stereophonic speakers).

It should be understood by those skilled in the art that various modifications, combinations, sub-combinations and alterations may occur depending on design requirements and other factors insofar as they are within the scope of the appended claims or the equivalents thereof.

What is claimed is:

1. A speaker apparatus comprising:

a housing substantially in a shape of a spheroid;

a first speaker attached to one end of a long side of said housing, said first speaker having a diaphragm whose front face faces outwardly of said housing; and a second speaker attached to another end of the long side of said housing, said second speaker having a diaphragm whose front face faces outwardly of said housing, wherein said first and second speakers are in diametrically opposed positions and are positioned at a same distance away from a central point of a central axis of said housing.

2. The speaker apparatus according to claim 1, further comprising a plurality of housing supporting sections disposed on a surface of said housing, said housing supporting sections projecting from said housing.

3. The speaker apparatus according to claim 2, wherein said housing supporting sections are in the shape of a ring whose central axis corresponds to a longitudinal axis of said housing.

4. The speaker apparatus according to claim 1, wherein said first speaker and said second speaker are disposed on a longitudinal axis of said housing.

5. The speaker apparatus according to claim 1, wherein said first speaker and said second speaker are not disposed on a longitudinal axis of said housing.

6. A reproducing apparatus comprising:

a housing substantially in the shape of a spheroid;

a first speaker attached to one end of a long side of said housing, said first speaker having a diaphragm whose front face faces outwardly of said housing;

a second speaker attached to another end of the long side of said housing, said second speaker having a diaphragm whose front face faces outwardly of said housing;

a storage section for storing audio data; and a reproducing section for converting said audio data read from said storage section into an audio signal and outputting said audio signal through said first speaker and said second speaker, wherein said first and second speakers are in diametrically opposed positions and are positioned at a same distance away from a central point of a central axis of said housing.

7. A reproducing apparatus comprising:

a housing substantially in the shape of a spheroid;

a first speaker attached to one end of a long side of said housing, said first speaker having a diaphragm whose front face faces outwardly of said housing;

a second speaker attached to another end of the long side of said housing, said second speaker having a diaphragm whose front face faces outwardly of said housing;

a reception section for receiving audio data; and a reproducing section for converting said audio data received by said reception section into an audio signal and outputting said audio signal through said first speaker and said second speaker, wherein said first and second sneakers are in diametrically opposed positions and are positioned at a same distance away from a central point of a central axis of said housing.

* * * * *